US009740172B2

(12) United States Patent
Kojima et al.

(10) Patent No.: US 9,740,172 B2
(45) Date of Patent: Aug. 22, 2017

(54) TIMEPIECE

(71) Applicant: SEIKO EPSON CORPORATION, Tokyo (JP)

(72) Inventors: Hiroyuki Kojima, Nagano (JP); Makoto Okeya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/004,021

(22) Filed: Jan. 22, 2016

(65) Prior Publication Data

US 2016/0223991 A1 Aug. 4, 2016

(30) Foreign Application Priority Data

Jan. 30, 2015 (JP) ..... 2015-016351
Jan. 30, 2015 (JP) ..... 2015-016352
Jan. 30, 2015 (JP) ..... 2015-016353

(51) Int. Cl.

| | |
|---|---|
| ***G04B 19/24*** | (2006.01) |
| ***G04C 10/04*** | (2006.01) |
| ***G04C 17/00*** | (2006.01) |
| ***G04B 19/247*** | (2006.01) |
| ***G04B 19/243*** | (2006.01) |

(52) U.S. Cl.

CPC ..... *G04B 19/247* (2013.01); *G04B 19/241* (2013.01); *G04B 19/24313* (2013.01); *G04C 10/04* (2013.01); *G04C 17/0066* (2013.01)

(58) Field of Classification Search

CPC G04B 19/24; G04B 19/241; G04B 19/24306; G04B 19/24313; G04B 19/2432; G04B 19/247; G04C 17/0016; G04C 17/0041; G04C 17/0058; G04C 17/0083; G04C 10/04

See application file for complete search history.

(56) References Cited

U.S. PATENT DOCUMENTS 4,232,510 A * 11/1980 Tamaru ..... G04B 19/2532 368/185
4,974,242 A 11/1990 Vuilleumier
5,299,177 A * 3/1994 Koch ..... G04C 3/14 368/28
5,473,580 A * 12/1995 Gilomen ..... G04C 3/146 368/110
2002/0024887 A1 2/2002 Triponez
2006/0126442 A1 * 6/2006 Hirano ..... G04B 19/24 368/223

(Continued)

FOREIGN PATENT DOCUMENTS

| | | |
|---|---|---|
| CH | 686106 B5 | 7/1996 |
| EP | 1672438 A2 | 6/2006 |
| JP | 02-156188 A | 6/1990 |

OTHER PUBLICATIONS

The Extended European Search Report for the corresponding European Application No. 16153133.0 dated Jun. 8, 2016.

*Primary Examiner* — Vit W Miska
(74) *Attorney, Agent, or Firm* — Global IP Counselors, LLP

(57) ABSTRACT

An analog electronic timepiece is an analog electronic watch capable of displaying a plurality of types of calendar information, and includes a first index adapted to indicate the type of the calendar information, and a second index adapted to indicate a value of the calendar information of the type indicated by the first index.

23 Claims, 31 Drawing Sheets

(56) References Cited

U.S. PATENT DOCUMENTS

| | | | | |
|---|---|---|---|---|
| 2006/0140057 | A1* | 6/2006 | Hirano | G04B 19/241 368/28 |
| 2007/0291593 | A1* | 12/2007 | Tokoro | G04B 19/241 368/221 |
| 2008/0130419 | A1* | 6/2008 | Watanabe | G04B 19/241 368/37 |

* cited by examiner

TIMEPIECE

BACKGROUND

1. Technical Field

The present invention relates to a timepiece for displaying calendar information.

2. Related Art

In the past, there has been known a timepiece for displaying the date with an index in analog timepieces (see, e.g., Japanese Patent No. 2,852,769 (Document 1)).

In the timepiece of Document 1, characters of 1 through 31 are displayed on an outer peripheral surface of the dial plate, and a date hand indicates these characters to thereby display the date.

Incidentally, in timepieces, it is required to display the month and the number of years elapsed from a leap year (hereinafter referred to simply as elapsed years) in addition to the date in some cases as in the perpetual clock. However, in the timepiece of Document 1, display of the month and the elapsed years is not disclosed. In the timepiece of Document 1, in order to display the month and the elapsed years in addition to the date, it is possible to, for example, make the date hand indicate symbols or a scale representing January through December and 0 year through 3 years in addition to the symbols or the scale representing $1^{st}$ through $31^{st}$. However, in this case, the number of the symbols and the scales to be indicated by the date hand increases, and it is necessary to decrease the distances between the indication positions. Therefore, there is a problem that it becomes difficult for the user to check the date, the month, and the elapsed years.

Further, in the case of the timepiece driven by a rechargeable battery (a second cell), it is required to detect and then display the amount of charge of the rechargeable battery in some cases. However, in the timepiece of Document 1, there is no disclosure regarding the fact that the battery is the rechargeable type, and the fact that the amount of charge is displayed. Therefore, there is desired a timepiece capable of displaying the amount of charge in addition to the calendar information.

Further, in the case of a timepiece provided with additional functions such as an alarm function or a chronograph function in addition to the calendar display function, it is required to display the information related to the additional functions in some cases. However, in the timepiece of Document 1, there is no disclosure regarding the fact that the information related to additional functions other than the calendar display function is displayed. Therefore, there is desired a timepiece capable of displaying the information related to additional functions in addition to the calendar information.

SUMMARY

An advantage of the invention is to provide a timepiece solving at least a part of the problems described above.

A first aspect of the invention is related to a timepiece capable of displaying a plurality of types of calendar information, including a first index adapted to indicate the type of the calendar information, and a second index adapted to indicate a value of the calendar information of the type indicated by the first index.

The types of the calendar information which can be displayed are, for example, the day, the month, and the number of years elapsed from a leap year, and the values of the calendar information are, for example, numbers of 0 through 31.

According to this aspect of the invention, when, for example, the user operates a button and so on of the timepiece to make the first index indicate one of the types of the calendar information, the second index indicates the value of the calendar information of the type indicated by the first index. Thus, it is possible for the user to check the calendar information based on the type of the calendar information indicated by the first index and the value of the calendar information indicated by the second index. Further, it is possible for the user to check a plurality of types of calendar information by operating the button and so on to switch the type of the calendar information indicated by the first index.

Further, since it is sufficient for the second index to indicate the values (0 through 31) of the calendar information, the intervals of the indication positions of the second index can be increased, and the calendar information can be displayed in an easy-to-understand manner compared to the case in which, for example, the second index indicates symbols or a scale representing the $1^{st}$ through $31^{st}$ days, symbols or a scale representing January through December, and symbols or a scale representing 0 through 3 years to thereby indicating the calendar information ($1^{st}$ through $31^{st}$ days, January through December, and 0 year through 3 years) only with the second index.

In the timepiece according to the first aspect of the invention, it is preferable that the types of the calendar information which can be indicated by the first index are day, month, and a number of years elapsed from a leap year, and the values of the calendar information which can be indicated by the second index are numbers of 0 through 31.

According to the aspect of the invention with this configuration, out of the numbers 0 through 31, the second index indicates either of the numbers 1 through 31 in the case in which the first index indicates the day, indicates either of the numbers 1 through 12 in the case in which the first index indicates the month, or indicates either of the numbers 0 through 3 in the case in which the first index indicates the elapsed years. Therefore, it is possible for the second index to indicate the value of the plurality of types of calendar information representing the values of the day, the month, and the elapsed years by indicating the 32 values of 0 through 31.

In the timepiece according to the first aspect of the invention, it is preferable that the first index is configured so as to be able to indicate a day of the week, and in a case in which the first index indicates the day of the week, the second index indicates the value of the day.

According to the aspect of the invention with this configuration, it is possible for the user to check the day of the week, and at the same time check the fact that the type of the calendar information is the day by the first index indicating the day of the week, and to check the value of the day based on the value indicated by the second index.

In general, the user may have an idea of checking the day of the week together with the value of the day in some cases. Therefore, by making it possible for the user to check the day of the week together with the value of the day, it is possible to make the timepiece easier to use.

Further, according to the aspect of the invention with this configuration, since there is no need to separately provide a dedicated index to the indication of the day of the week in addition to the first index and the second index, the number of the indexes provided to the timepiece can be decreased compared to the case of separately providing the dedicated index.

In the timepiece according to the first aspect of the invention, it is preferable that the types of the calendar information which can be indicated by the first index are day, month, and a number of years elapsed from a leap year, the values of the calendar information which can be indicated by the second index are numbers of 0 through 31, the second index is configured so as to be able to make a movement with a normal rotation and a movement with a reverse rotation, and a movement range of the second index is limited within a range of indicating the numbers of 1 through 12 in a case in which the first index indicates the month, and limited within a range of indicating the numbers of 0 through 3 in a case in which the first index indicates the number of years elapsed from a leap year.

Here, the indication positions of the numbers of 0 through 31 with the second index are arranged so that the numbers of 0 through 31 are indicated in series in the case in which the second index makes a movement with the normal rotation.

According to the aspect of the invention with this configuration, in the case in which the time has passed and the value of the calendar information has been updated, and the second index indicates the next value, and the case of making the second index indicate the next value when the user operates the crown or the like of the timepiece to move the second index to thereby set the value of the calendar information, the second index moves in the following manner.

Specifically, in the case in which the first index indicates the month, and the second index indicates the number of 12, the second index makes a movement with the reverse rotation to indicate the number of 1 passing through the positions of indicating the numbers of 2 through 11. Therefore, the movement length of the second index can be shortened compared to the case in which the second index makes a movement with the normal rotation to indicate the number of 1 passing through the positions of indicating the numbers of 13 through 31 and 0.

Further, in the case in which the first index indicates the elapsed years, and the second index indicates the number of 3, the second index makes a movement with the reverse rotation to indicate the number of 0 passing through the positions of indicating the numbers of 1 and 2. Therefore, the movement length of the second index can be shortened compared to the case in which the second index makes a movement with the normal rotation to indicate the number of 0 passing through the positions of indicating the numbers of 4 through 31.

Thus, the power consumption of the timepiece can be reduced, and further, the setting of the values of the calendar information can promptly be performed.

It should be noted that in the case in which the first index indicates the day, and the second index indicates the number of 31, the second index makes a movement with the normal rotation to indicate the number of 1 passing through the position of indicating the numbers of 0.

In the timepiece according to the first aspect of the invention, it is preferable that the types of the calendar information which can be indicated by the first index are day, month, and a number of years elapsed from a leap year, the values of the calendar information which can be indicated by the second index are numbers of 0 through 31, and the second index moves through a position of indicating the number of 0 with fast-forwarding in a case in which the first index indicates the day, through positions of indicating the numbers of 0 and 13 through 31 with fast-forwarding in a case in which the first index indicates the month, and through positions of indicating the numbers of 4 through 31 with fast-forwarding in a case in which the first index indicates the number of years elapsed from a leap year.

According to the aspect of the invention with this configuration, when the user sets the values of the calendar information by operating the crown and so on of the timepiece to move the second index, since the second index moves through the positions of indicating the values, which are not the setting target, with fast-forwarding, setting of the values of the calendar information can promptly be performed compared to the case in which the fast-forwarding is not used in the movement.

In the timepiece according to the first aspect of the invention, it is preferable to further include a first drive unit adapted to drive the first index, a second drive unit adapted to drive the second index, an operation unit, a detection section adapted to detect an operation to the operation unit to output a detection signal upon detection of the operation, and a calendar display processing section adapted to control the first drive unit to switch the type of the calendar information indicated by the first index upon input of the detection signal, and control the second drive unit to make the second index indicate the value of the calendar information of the type indicated by the first index upon input of the detection signal.

According to the aspect of the invention with this configuration, by the user operating the operation unit, the detection signal is output from the detection section, and then the detection signal is input to the calendar display processing section. Then, the calendar display processing section switches the types of the calendar information to be indicated by the first index, and makes the second index indicate the value of the calendar information of the type indicated by the first index.

According to this configuration, the user can immediately check the calendar information of the type the user wants to check by operating the operation unit.

A second aspect of the invention is related to a timepiece capable of displaying a plurality of types of calendar information, including a secondary cell, a charge amount detection section adapted to detect an amount of charge of the secondary cell, a first index adapted to indicate the type of the calendar information, and a second index adapted to indicate a value of the calendar information of the type indicated by the first index, wherein the first index is configured so as to be able to indicate the charge amount.

The types of the calendar information which can be displayed are, for example, the day, the month, and the number of years elapsed from a leap year, and the values of the calendar information are, for example, numbers of 0 through 31.

According to this aspect of the invention, when, for example, the user operates a button and so on of the timepiece to make the first index indicate one of the types of the calendar information, the second index indicates the value of the calendar information of the type indicated by the first index. Thus, it is possible for the user to check the calendar information based on the type of the calendar information indicated by the first index and the value of the calendar information indicated by the second index. Further, it is possible for the user to check a plurality of types of calendar information by operating the button and so on to switch the type of the calendar information indicated by the first index.

Further, since it is sufficient for the second index to indicate the values (0 through 31) of the calendar information, the intervals of the indication positions of the second index can be increased, and the calendar information can be displayed in an easy-to-understand manner compared to the case in which, for example, the second index indicates symbols or a scale representing the $1^{st}$ through $31^{st}$ days, symbols or a scale representing January through December, and symbols or a scale representing 0 through 3 years to thereby indicating the calendar information ($1^{st}$ through $31^{st}$ days, January through December, and 0 year through 3 years) only with the second index.

Further, according to this aspect of the invention, it is possible for the user to check the charge amount by operating the button or the like of the timepiece to make the first index indicate the charge amount.

Further, in this aspect of the invention, since the indication of the charge amount is performed by the first index for indicating the type of the calendar information, there is no need to separately provide a dedicated index to the indication of the charge amount, and the number of the indexes provided to the timepiece can be decreased compared to the case of separately providing the dedicated index.

Further, according to this aspect of the invention, it is also possible to make, for example, the second index indicate the value of the specific type of the calendar information when the first index indicates the charge amount. In this case, the user can check the charge amount and the calendar information at the same time.

In the timepiece according to the second aspect of the invention, it is preferable that the types of the calendar information which can be indicated by the first index are day, month, and a number of years elapsed from a leap year, and the values of the calendar information which can be indicated by the second index are numbers of 0 through 31.

According to the aspect of the invention with this configuration, out of the numbers 0 through 31, the second index indicates either of the numbers 1 through 31 in the case in which the first index indicates the day, indicates either of the numbers 1 through 12 in the case in which the first index indicates the month, or indicates either of the numbers 0 through 3 in the case in which the first index indicates the elapsed years. Therefore, it is possible for the second index to indicate the value of the plurality of types of calendar information representing the values of the day, the month, and the elapsed years by indicating the 32 values of 0 through 31.

In the timepiece according to the second aspect of the invention, it is preferable that in a case in which the first index indicates the charge amount, the second index indicates the value of the day.

According to the aspect of the invention with this configuration, it is possible for the user to check the charge amount, and at the same time check the fact that the type of the calendar information is the day by the first index indicating the charge amount, and to check the value of the day based on the value indicated by the second index.

Therefore, since the user can always check the value of the day and the charge amount by keeping the first index indicating the charge amount, it is possible to make the timepiece easier to use.

In the timepiece according to the second aspect of the invention, it is preferable that the first index is configured so as to be able to indicate a day of the week, and in a case in which the first index indicates the day of the week, the second index indicates the value of the day.

According to the aspect of the invention with this configuration, it is possible for the user to check the day of the week, and at the same time check the fact that the type of the calendar information is the day by the first index indicating the day of the week, and to check the day information based on the value indicated by the second index.

In general, the user may have an idea of checking the day of the week together with the value of the day in some cases. Therefore, by making it possible for the user to check the day of the week together with the value of the day, it is possible to make the timepiece easier to use.

Further, according to the aspect of the invention with this configuration, since there is no need to separately provide a dedicated index to the indication of the day of the week in addition to the first index and the second index, the number of the indexes provided to the timepiece can be decreased compared to the case of separately providing the dedicated index.

In the timepiece according to the second aspect of the invention, it is preferable that in a case in which indication of the charge amount by the first index is absent, the first index indicates the charge amount in accordance with a drop of the charge amount to a level lower than a predetermined threshold value.

According to the aspect of the invention with this configuration, even in the case in which the first index does not indicate the charge amount, if the charge amount of the secondary cell drops to a level lower than the threshold value, the first index automatically indicates the charge amount, and therefore, the user can check the fact that the charge amount has dropped. Thus, it is possible to surely inform the user of the fact that the charge amount of the secondary cell has dropped to thereby reduce the possibility that the charge fails to occur to cause a system failure.

In the timepiece according to the second aspect of the invention, it is preferable that the timepiece is capable of performing a function other than the function of displaying the calendar information, the first index is configured so as to be able to indicate a type of the additional function, and there is further included a third index adapted to indicate information related to the function of the type indicated by the first index in a case in which the first index indicates the type of the additional function.

The additional function is, for example, an alarm function, and the information related to the additional function is, for example, alarm time.

According to the aspect of the invention with this configuration, by checking the type of the function indicated by the first index, the user can check what function is related to the information indicated by the third index.

Further, according to the aspect of the invention with this configuration, it is also possible to make, for example, the second index indicate the value of the specific type of the calendar information when the first index indicates the type of the additional function. In this case, the user can check the information related to the additional function and the calendar information at the same time.

In the timepiece according to the second aspect of the invention, it is preferable that execution of the additional function is restricted in a case in which the charge amount reaches a level lower than a predetermined threshold value.

According to the aspect of the invention with this configuration, since the execution of the additional function is restricted if the charge amount drops to a level lower than the threshold value, the power consumption can be reduced compared to the case in which the restriction is not applied, and the possibility of the system failure can be reduced.

Further, the situation that the additional function is not correctly performed can be prevented from occurring.

In the timepiece according to the second aspect of the invention, it is preferable to further include a first drive unit adapted to drive the first index, a second drive unit adapted to drive the second index, an operation unit, a detection section adapted to detect an operation to the operation unit to output a detection signal upon detection of the operation, and a calendar display processing section adapted to control the first drive unit to switch an indication position of the first index upon input of the detection signal, and control the second drive unit to make the second index indicate the value of the calendar information of the type indicated by the first index in a case in which the first index indicates the type of the calendar information.

According to the aspect of the invention with this configuration, by the user operating the operation unit, the detection signal is output from the detection section, and then the detection signal is input to the calendar display processing section. Then, the calendar display processing section switches the indication position of the first index, and makes the second index indicate the value of the calendar information of the type indicated by the first index in the case in which the first index indicates the type of calendar information.

According to this configuration, the user can immediately check the calendar information of the type the user wants to check and the charge amount by operating the operation unit.

A third aspect of the invention is related to a timepiece capable of performing a plurality of functions including a function of displaying calendar information, including a first index adapted to indicate a type of calendar information and a type of an additional function other than the function of displaying the calendar information, a second index adapted to indicate a value of the calendar information of the type indicated by the first index in a case in which the first index indicates the type of the calendar information, and a third index adapted to indicate information related to the function of the type indicated by the first index in a case in which the first index indicates the type of the additional function.

The types of the calendar information which can be displayed are, for example, the day, the month, and the number of years elapsed from a leap year, and the values of the calendar information are, for example, numbers of 0 through 31. Further, the additional function is, for example, an alarm function, and the information related to the additional function is, for example, alarm time.

According to this aspect of the invention, when, for example, the user operates a button and so on of the timepiece to make the first index indicate one of the types of the calendar information, the second index indicates the value of the calendar information of the type indicated by the first index. Thus, it is possible for the user to check the calendar information based on the type of the calendar information indicated by the first index and the value of the calendar information indicated by the second index. Further, it is possible for the user to check a plurality of types of calendar information by operating the button and so on to switch the type of the calendar information indicated by the first index.

Further, since it is sufficient for the second index to indicate the values (0 through 31) of the calendar information, the intervals of the indication positions of the second index can be increased, and the calendar information can be displayed in an easy-to-understand manner compared to the case in which, for example, the second index indicates symbols or a scale representing the $1^{st}$ through $31^{st}$ days, symbols or a scale representing January through December, and symbols or a scale representing 0 through 3 years to thereby indicating the calendar information ($1^{st}$ through $31^{st}$ days, January through December, and 0 year through 3 years) only with the second index.

Further, according to this aspect of the invention, when the user operates a button and so on of the timepiece to make the first index indicate the type of the additional function, the third index indicates the information related to the function of the type indicated by the first index. Therefore, by checking the type of the function indicated by the first index, the user can check what function is related to the information indicated by the third index.

Further, according to this aspect of the invention, it is also possible to make, for example, the second index indicate the value of the specific type of the calendar information when the first index indicates the type of the additional function. In this case, the user can check the information related to the additional function and the calendar information at the same time.

Further, according to the aspect of the invention with this configuration, even in the case in which the timepiece is provided with a plurality of additional functions, the information related to the plurality of functions can be indicated by indicating the type of the function with the first index, and indicating the information related to the function of the type indicated by the first index with the third index, the number of the indexes provided to the timepiece can be reduced compared to the case of separately providing the dedicated indexes to the respective functions. Further, since the indication area of the indexes can be enlarged, the information related to each of the functions can be displayed in an easy-to-understand manner.

In the timepiece according to the third aspect of the invention, it is preferable that the types of the calendar information which can be indicated by the first index are day, month, and a number of years elapsed from a leap year, and the values of the calendar information which can be indicated by the second index are numbers of 0 through 31.

According to the aspect of the invention with this configuration, out of the numbers 0 through 31, the second index indicates either of the numbers 1 through 31 in the case in which the first index indicates the day, indicates either of the numbers 1 through 12 in the case in which the first index indicates the month, or indicates either of the numbers 0 through 3 in the case in which the first index indicates the elapsed years. Therefore, it is possible for the second index to indicate the value of the plurality of types of calendar information representing the values of the day, the month, and the elapsed years by indicating the 32 values of 0 through 31.

In the timepiece according to the third aspect of the invention, it is preferable that the first index is configured so as to be able to indicate a day of the week, and in a case in which the first index indicates the day of the week, the second index indicates the value of the day.

According to the aspect of the invention with this configuration, it is possible for the user to check the day of the week, and at the same time check the fact that the type of the calendar information is the day by the first index indicating the day of the week, and to check the day information based on the value indicated by the second index.

In general, the user may have an idea of checking the day of the week together with the value of the day in some cases. Therefore, by making it possible for the user to check the day of the week together with the value of the day, it is possible to make the timepiece easier to use.

Further, according to the aspect of the invention with this configuration, since there is no need to separately provide a dedicated index to the indication of the day of the week, the number of the indexes provided to the timepiece can be decreased compared to the case of separately providing the dedicated index.

In the timepiece according to the third aspect of the invention, it is preferable that one of the additional functions is an alarm function, and in a case in which the first index indicates the alarm function as the type of the additional function, the third index indicates alarm time set in the alarm function.

According to the aspect of the invention with this configuration, the user can check the alarm time based on the indication of the third index by operating the button or the like of the timepiece to make the first index indicate the alarm function as the type of the additional function.

Further, the third index is provided with, for example, an hour hand and a minute hand in order to indicate the alarm time. In this case, in the case in which the first index does not indicate the alarm function, it is also possible to indicate the hour and the minute of the current time with the hour hand and the minute hand. Further, in the case in which the hour hand is formed of a twenty-four-hour hand, it is possible to indicate the current hour with the twenty-four-hour hand.

In the timepiece according to the third aspect of the invention, it is preferable that one of the additional functions is a chronograph function, and in a case in which the first index indicates the chronograph function as the type of the additional function, the third index indicates measured time of the chronograph function.

According to the aspect of the invention with this configuration, the user can check the measured time of the chronograph function based on the indication of the third index by operating the button or the like of the timepiece to make the first index indicate the chronograph function as the type of the additional function.

Further, the third index is provided with, for example, a minute hand and a second hand in order to indicate the measured time of the chronograph function. In this case, in the case in which the first index does not indicate the chronograph function, it is also possible to indicate the hour and the minute of the current time with the two indexes.

In the timepiece according to the third aspect of the invention, it is preferable that one of the additional functions is a chronograph function, and in a case in which the first index indicates the chronograph function as the type of the additional function, the second index and the third index indicate measured time of the chronograph function.

According to the aspect of the invention with this configuration, even in the case in which, for example, the third index is constituted only by the hour hand and the minute hand, by making the third index indicate the hour and the minute of the measured time, and making the second index indicate the second of the measured time, the hour, the minute, and the second of the measured time can be indicated.

In the timepiece according to the third aspect of the invention, it is preferable that one of the additional functions is a timer function, and in a case in which the first index indicates the timer function as the type of the additional function, the third index indicates measured time of the timer function.

According to the aspect of the invention with this configuration, the user can check the measured time of the timer function based on the indication of the third index by operating the button or the like of the timepiece to make the first index indicate the timer function as the type of the additional function.

In the timepiece according to the third aspect of the invention, it is preferable that one of the additional functions is a dual time display function, and in a case in which the first index indicates the dual time display function as the type of the additional function, the third index indicates set time set in the dual time display function.

According to the aspect of the invention with this configuration, the user can check the set time of the dual time display function based on the indication of the third index by operating the button or the like of the timepiece to make the first index indicate the dual time display function as the type of the additional function.

Further, the third index is provided with, for example, an hour hand and a minute hand in order to indicate the set time. In this case, in the case in which the first index does not indicate the dual time display function, it is also possible to indicate the hour and the minute of the current time with the hour hand and the minute hand.

In the timepiece according to the third aspect of the invention, it is preferable to further include a first drive unit adapted to drive the first index, a second drive unit adapted to drive the second index, a third drive unit adapted to drive the third index, an operation unit, a detection section adapted to detect an operation to the operation unit to output a detection signal upon detection of the operation, a calendar display processing section adapted to control the first drive unit to switch an indication position of the first index upon input of the detection signal, and control the second drive unit to make the second index indicate the value of the calendar information of the type indicated by the first index in a case in which the first index indicates the type of the calendar information, and a function section adapted to control the third drive unit to make the third index indicate information related to the function of the type indicated by the first index in a case in which the first index indicates the type of the additional function.

According to the aspect of the invention with this configuration, by the user operating the operation unit, the detection signal is output from the detection section, and then the detection signal is input to the calendar display processing section. Then, the calendar display processing section switches the indication position of the first index, and makes the second index indicate the value of the calendar information of the type indicated by the first index in the case in which the first index indicates the type of calendar information. Further, in the case in which the first index indicates the type of an additional function, the function section makes the third index indicate the information related to the function of the type indicated by the first index.

According to this configuration, the user can immediately check the calendar information of the type the user wants to check and the information related to the additional function by operating the operation unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Some embodiments of the invention will hereinafter be described with reference to the accompanying drawings.

First Embodiment

Figure 1:
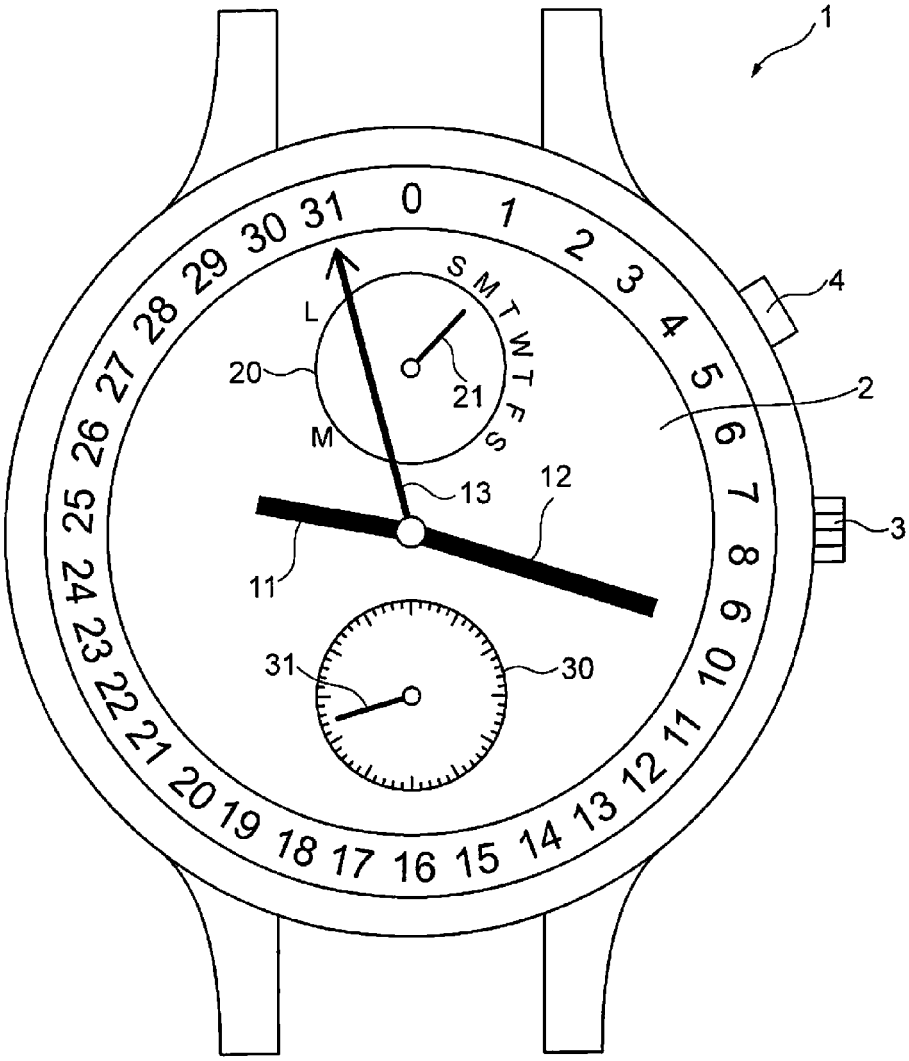
FIG. 1 is a front view of an analog electronic watch according to a first embodiment of the invention.

FIG. 1 is a front view showing an analog electronic watch 1. Here, the analog electronic watch 1 constitutes a timepiece according to the invention.

As shown in FIG. 1, the analog electronic watch 1 is provided with a dial plate 2 having a circular shape. The dial plate 2 is provided with a first small window 20 having a circular shape and located at a position shifted toward the 12 o'clock direction from the center, and a second small window 30 having a circular shape and located at a position shifted toward the 6 o'clock direction from the center viewed from the obverse side of the watch.

Further, the analog electronic watch 1 is provided with an hour hand 11, a minute hand 12, and a second hand 31 as basic watch indexes for performing normal time display. The hour hand 11 and the minute hand 12 each have a rotary shaft located at the center of the dial plate 2. The second hand 31 is disposed in the second small window 30.

Further, the analog electronic watch 1 is provided with the second index 13 as a center hand having a rotary shaft located at the center of the dial plate 2. Further, on the outer peripheral surface of the dial plate 2, there are displayed numbers of 0 through 31 along the outer peripheral edge. Here, the numbers of 0 through 31 are arranged clockwise in series from the 12 o'clock position viewed from the obverse side of the clock. It should be noted that although the numbers of 1 through 31 are arranged at regular intervals, the distance between 0 and 1, and the distance between 31 and 0 are larger than the distances between other numbers. By the second index 13 indicating these numbers, there is indicated the value of the calendar information of either of the types of the day, the month, and the elapse years from a leap year (0, +1 through +3).

Further, the analog electronic watch 1 is provided with a first index 21 disposed in the first small window 20. Further, in the periphery of the first small window 20, characters of "S," "M," "T," "W," "T," "F," "S" respectively representing seven days of the week of Sunday through Saturday are displayed in the vicinity of the 1 o'clock position through the vicinity of the 4 o'clock position of the first small window 20. Further, in the periphery of the first small window 20, a character of "M" representing the month is displayed in the vicinity of the 8 o'clock position of the first small window 20, and a character of "L" representing the elapsed years is displayed in the vicinity of the 10 o'clock position.

The first index 21 indicates one of the characters "S" through "S" representing the seven days of the week to thereby indicate the day of the week. Further, the first index 21 indicates the type of the calendar information. In other words, by indicating the characters "S" through "S," the first index 21 indicates the day of the week, and at the same time indicates the fact that the type of the calendar information is the day. Further, the first index 21 indicates the character "M" to thereby indicate the fact that the type of the calendar information is the month. Further, the first index 21 indicates the character "L" to thereby indicate the fact that the type of the calendar information is the elapsed years.

Further, the analog electronic watch 1 is provided with a crown 3 as an external operation member, and a button 4, which is also an external operation member. Here, the button 4 constitutes an operation unit according to the invention.

Figure 2:
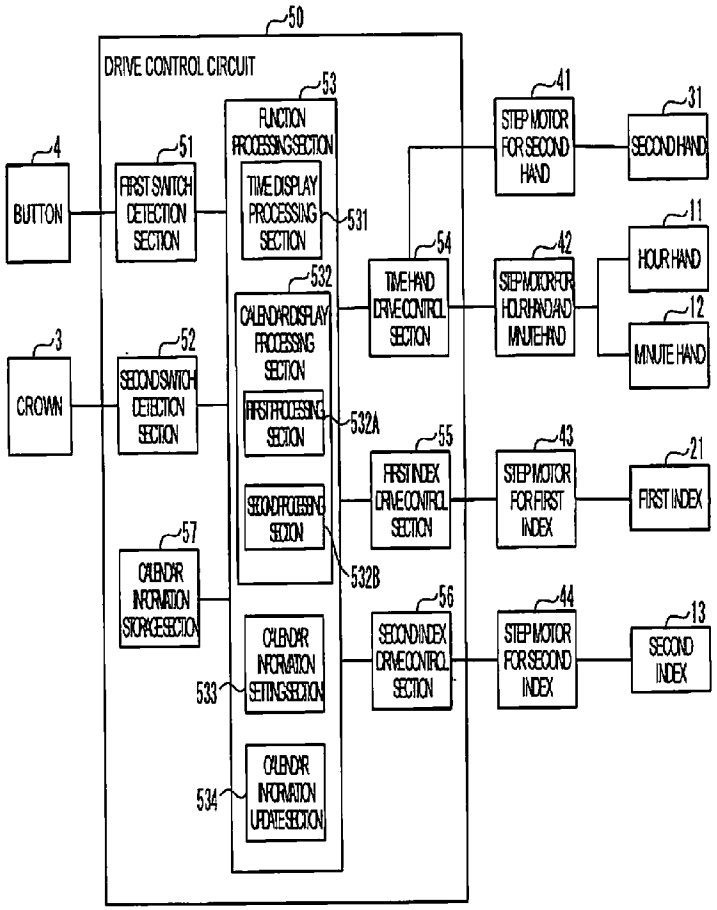
FIG. 2 is a block diagram showing a configuration of the analog electronic watch according to the first embodiment.

FIG. 2 is a block diagram showing a configuration of the analog electronic watch 1.

As shown in FIG. 2, the indexes 11 through 13, 21, and 31 are respectively driven by four step motors. Specifically, the second hand 31 is driven by the step motor 41 for the second hand, the hour hand 11 and the minute hand 12 are driven by the step motor 42 for the hour hand and the minute hand, the first index 21 is driven by the step motor 43 for the first index, and the second index 13 is driven by the step motor 44 for the second index. Here, the step motor. 43 for the first index constitutes a first drive unit according to the invention, and the step motor 44 for the second index constitutes a second drive unit according to the invention. It should be noted that it is also possible for the second hand 31, the hour hand 11, and the minute hand 12 to be driven by a common step motor.

In order to perform the drive control of each of the step motors 41 through 44, a drive control circuit 50 is incorporated in the analog electronic watch 1.

The drive control circuit 50 is provided with a first switch detection section 51, a second switch detection section 52, a function processing section 53, a time hand drive control section 54, a first index drive control section 55, a second index drive control section 56, and a calendar information storage section 57.

The first switch detection section 51 detects a push-in operation of the button 4, and outputs the detection signal to the function processing section 53 in the case in which the push-in operation has occurred. Here, the first switch detection section 51 constitutes a detection section according to the invention.

The second switch detection section 52 detects an operation of the crown 3, and outputs a detection signal corresponding to the operation to the function processing section 53 in the case in which the operation has occurred.

The time hand drive control section 54 outputs a motor drive pulse using a reference signal (e.g., a signal of 1 Hz) output from a reference signal generation circuit such as a crystal resonator to control the step motor 41 for the second hand and the step motor 42 for the hour hand and the minute hand to thereby control the drive of the hour hand 11, the minute hand 12, and the second hand 31.

The first index drive control section 55 outputs a motor drive pulse using the reference signal output from the reference signal generation circuit to control the step motor 43 for the first index to thereby control the drive of the first index 21.

The second index drive control section 56 outputs a motor drive pulse using the reference signal output from the reference signal generation circuit to control the step motor 44 for the second index to thereby control the drive of the second index 13.

The calendar information storage section 57 stores day information representing the value of the day, month information representing the value of the month, elapsed-year information representing the value of the elapsed years, and day-of-the-week information representing the day of the week. The calendar information stored in the calendar information storage section 57 is set by a calendar information setting section 533 described later, and is updated by a calendar information update section 534 described later.

The function processing section 53 is for performing processing of a variety of functions in the analog electronic watch 1. The function processing section 53 is provided with a time display processing section 531, a calendar display processing section 532, a calendar information setting section 533, and a calendar information update section 534.

The time display processing section 531 is for displaying the hour, the minute, and the second of the current time with the hour hand 11, the minute hand 12, and the second hand 31 using the time hand drive control section 54.

The calendar information setting section 533 sets the values of the calendar information stored in the calendar information storage section 57 based on the operation of the button 4 in a calendar information setting mode. It should be noted that the specific setting process of the calendar information will be described later.

The calendar information update section 534 measures the time using the reference signal output from the reference signal generation circuit, and then updates the values of the calendar information stored in the calendar information storage section 57 in accordance with the passage of time. Therefore, the calendar information storage section 57 stores the current day information, the current month information, the current elapsed-year information, and the current day-of-the-week information.

The calendar display processing section 532 is provided with a first processing section 532A and a second processing section 532B.

The first processing section 532A controls the step motor 43 for the first index to thereby control the movement of the first index 21. Specifically, when the button 4 is pushed in, and the detection signal is input from the first switch detection section 51 in a normal mode, the first processing section 532A moves the first index 21 to switch the type of the calendar information indicated by the first index 21.

Here, when making the first index 21 indicate the fact that the type of the calendar information is the day, the first processing section 532A makes the first index 21 indicate the character corresponding to the day-of-the-week information stored in the calendar information storage section 57 out of the characters "S" through "S" representing the seven days of the week to thereby indicate the day of the week.

The second processing section 532B controls the step motor 44 for the second index to thereby control the movement of the second index 13.

Specifically, when the type of the calendar information to be indicated by the first index 21 has been switched in the normal mode, the second processing section 532B makes the second index 13 indicate the number corresponding to the value of the type of the calendar information to be indicated by the first index 21 out of the calendar information stored in the calendar information storage section 57 to thereby indicate the value of the calendar information.

Calendar Information Setting Process

Then, the setting process of the calendar information stored in the calendar information storage section 57 will be described.

When the crown 3 is pulled out, the function processing section 53 makes the transition to the calendar information setting mode. When the button 4 is held down in this state, the first processing section 532A moves the first index 21 to sequentially indicate the characters "S" through "S" representing the seven days of the week, the character "M" representing the month, and the character "L" representing the elapsed years. Further, when the crown 3 is rotationally operated, the second processing section 532B moves the second index 13.

Then, when the crown 3 is rotationally operated to move the second index 13 and then the crown 3 is pushed in in the state in which the first index 21 indicates either of the characters "S" through "S," the calendar information setting section 533 sets the value of the number indicated by the second index 13 as the value of the day information of the calendar information storage section 57.

Further, when the crown 3 is rotationally operated to move the second index 13 and then the crown 3 is pushed in in the state in which the first index 21 indicates the character "M" representing the month, the calendar information setting section 533 sets the value of the number indicated by the second index 13 as the value of the month information of the calendar information storage section 57.

Further, when the crown 3 is rotationally operated to move the second index 13 and then the crown 3 is pushed in in the state in which the first index 21 indicates the character "L" representing the elapsed years, the calendar information setting section 533 sets the value of the number indicated by the second index 13 as the value of the elapsed-year information of the calendar information storage section 57.

It should be noted that when the crown 3 is pushed in in the state in which the first index 21 indicates either of the characters "S" through "S" representing the seven days of the week, the calendar information setting section 533 sets the day of the week indicated by the first index 21 as the day-of-the-week information of the calendar information storage section 57.

Then, when the crown 3 is pushed in as described above, the function processing section 53 makes the transition to the normal mode.

It should be noted that in the present embodiment, although the second index 13 is moved by the crown 3 being rotationally operated in the calendar information setting mode, it is also possible to provide a button different from the button 4 to the analog electronic watch 1, and arrange that the second index 13 is moved by the button being pushed in.

Calendar Display Process

Then, the calendar display process performed by the calendar display processing section 532 will be described.

Figure 3:
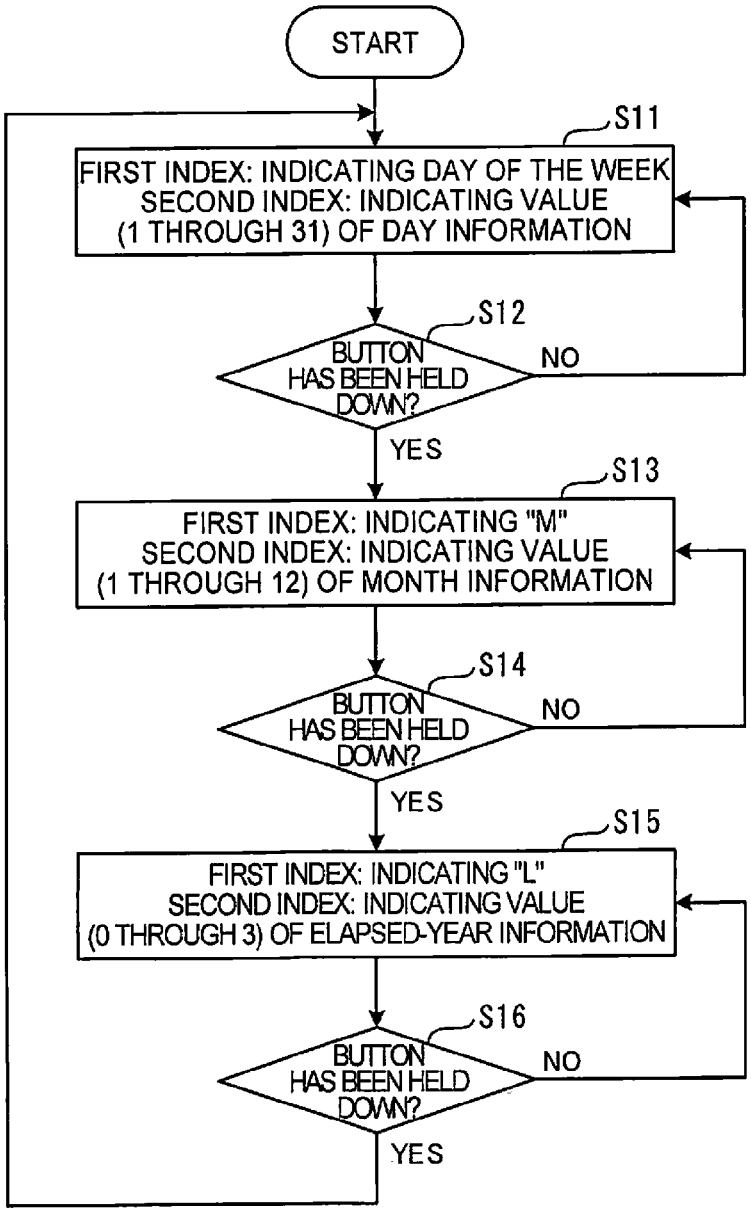
FIG. 3 is a flowchart showing a calendar display process in the first embodiment.

FIG. 3 is a flowchart showing the calendar display process. The calendar display process is performed while the function processing section 53 is in the normal mode.

When the calendar display process is performed, the first processing section 532A makes the first index 21 move to indicate the character corresponding to the day-of-the-week information stored in the calendar information storage section 57 out of the characters "S" through "S" representing the seven days of the week to thereby indicate the day of the week as shown in FIG. 1. Further, thus, the first processing section 532A makes the first index 21 indicate the fact that the type of the calendar information is the day. Further, the second processing section 532B moves the second index 13 to indicate the number corresponding to the value (1 through 31) of the day information stored in the calendar information storage section 57 to thereby indicate the value of the day information. Due to these operations, the day information is displayed (S11). It should be noted that this display state corresponds to a display state in the normal period.

Then, the calendar display processing section 532 determines whether or not the detection signal is input from the first switch detection section 51 to thereby determine (S12) whether or not the button 4 has been held down.

In the case in which the determination of NO has been made in the step S12, the first processing section 532A and the second processing section 532B continue the process of the step S11. It should be noted that in the case in which the time has passed while the state of YES is not determined in the step S12, and the value of the day information and the day-of-the-week information stored in the calendar information storage section 57 have been updated, the first processing section 532A moves the first index 21 to indicate the day of the week having been updated, and the second processing section 532B moves the second index 13 to indicate the value of the day information having been updated.

Figure 4:
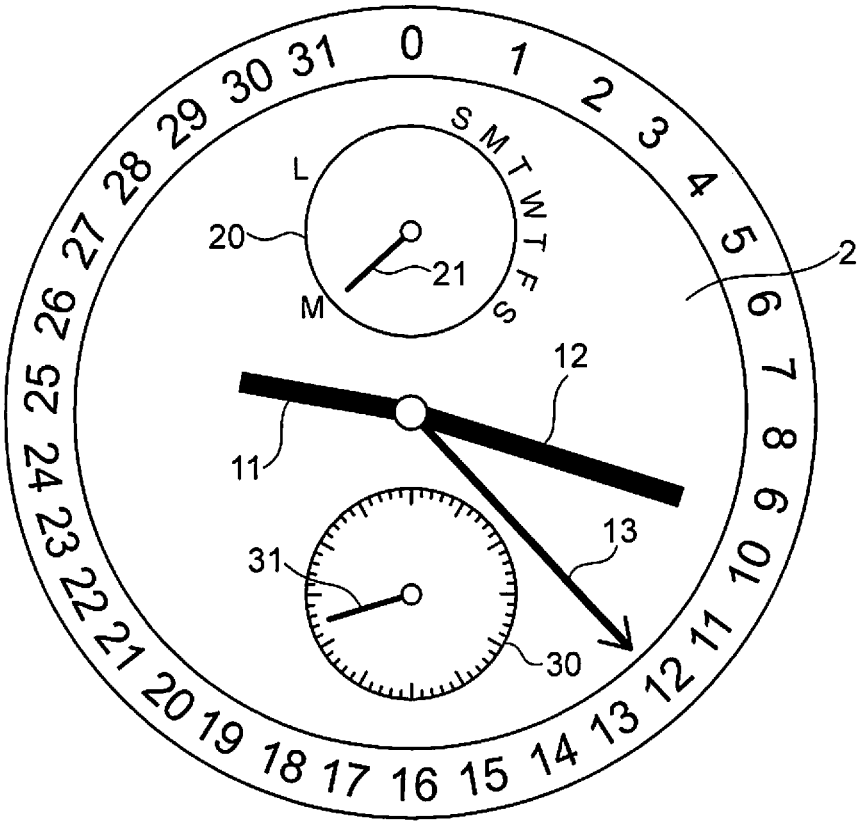
FIG. 4 is a diagram showing a display example of the analog electronic watch according to the first embodiment.

On the other hand, in the case in which the determination of YES has been made in the step S12, the first processing section 532A moves the first index 21 to indicate the character "M" representing the month, and thus indicate the fact that the type of the calendar information is the month as shown in FIG. 4. Further, the second processing section 532B moves the second index 13 to indicate the number corresponding to the value (1 through 12) of the month information stored in the calendar information storage section 57 to thereby indicate the value of the month information. Due to these operations, the month information is displayed (S13).

Then, the calendar display processing section 532 determines (S14) whether or not the detection signal has been input from the first switch detection section 51.

In the case in which the determination of NO has been made in the step S14, the first processing section 532A and the second processing section 532B continue the process of the step S13. It should be noted that in the case in which the time has passed while the state of YES is not determined in the step S14, and the value of the month information stored in the calendar information storage section 57 has been updated, the second processing section 532B moves the second index 13 to indicate the value of the month information having been updated.

Figure 5:
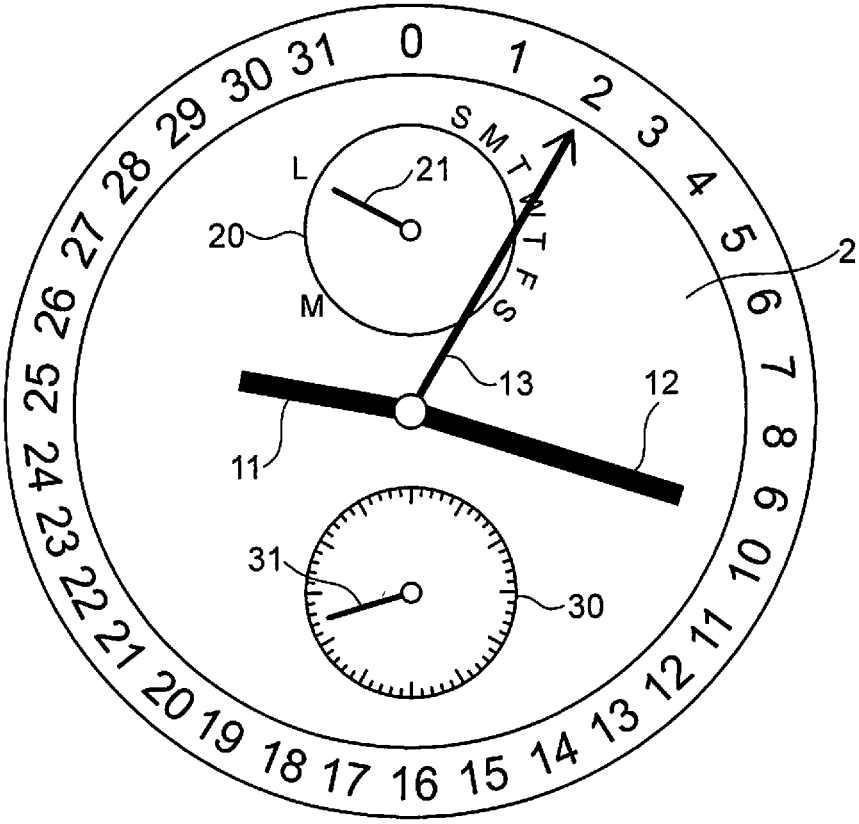
FIG. 5 is a diagram showing another display example of the analog electronic watch according to the first embodiment.

On the other hand, in the case in which the determination of YES has been made in the step S14, the first processing section 532A moves the first index 21 to indicate the character "L" representing the elapsed years, and thus indicate the fact that the type of the calendar information is the elapsed years as shown in FIG. 5. Further, the second processing section 532B moves the second index 13 to indicate the number corresponding to the value (0 through 3) of the elapsed-year information stored in the calendar information storage section 57 to thereby indicate the value of the elapsed-year information. Due to these operations, the elapsed-year information is displayed (S15).

Then, the calendar display processing section 532 determines (S16) whether or not the detection signal has been output from the first switch detection section 51.

In the case in which the determination of NO has been made in the step S16, the first processing section 532A and the second processing section 532B continue the process of the step S15. It should be noted that in the case in which the time has passed while the state of YES is not determined in the step S16, and the value of the elapsed-year information stored in the calendar information storage section 57 has been updated, the second processing section 532B moves the second index 13 to indicate the value of the elapsed-year information having been updated.

On the other hand, in the case in which the determination of YES has been made in the step S16, the calendar display processing section 532 returns the process to the step S11, and then repeatedly performs the processes of the steps S11 through S16.

Method of Moving Second Index

Then, a method of moving the second index 13 by the second processing section 532B will be described.

The second processing section 532B moves the second index 13 in the following manner when the time has passed, the value of the calendar information stored in the calendar information storage section 57 has been updated, and the second index 13 is made to indicate the next value, or when the crown 3 has been rotationally operated in the calendar information setting mode, and the second index 13 is made to indicate the next value.

Figure 6:
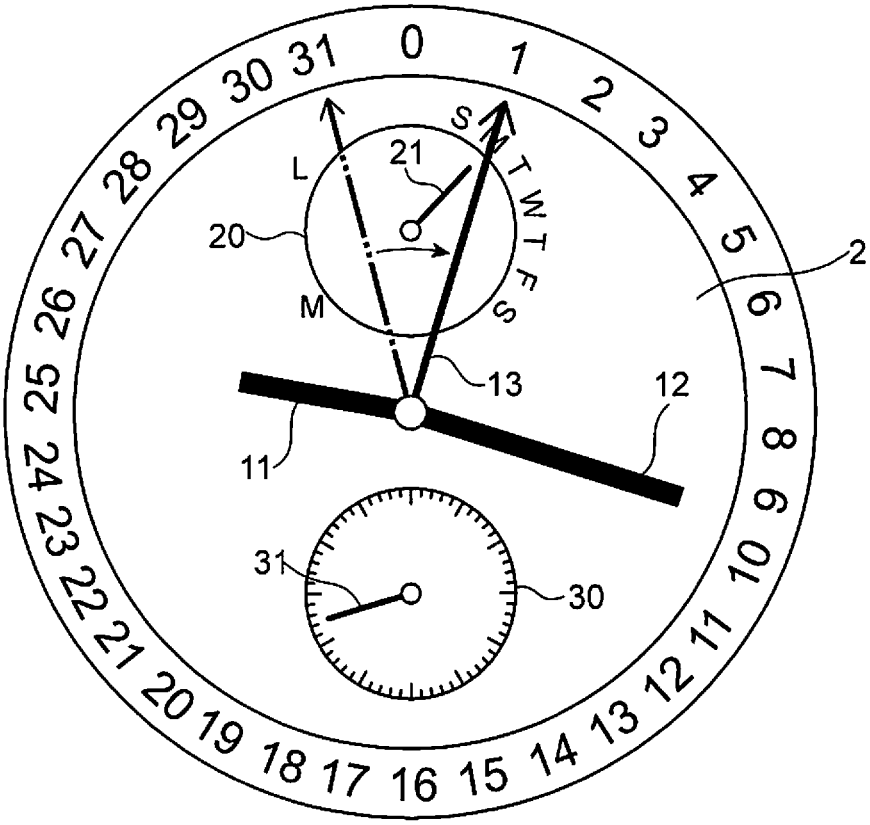
FIG. 6 is a diagram showing a movement example of a second index in the first embodiment.

Firstly, there will be described the case in which the first index 21 indicates the day of the week to thereby indicate the fact that the type of the calendar information is the day. In this case, in the case in which the second index 13 indicates either of the numbers of 1 through 30, the second index 13 is rotated clockwise (normal rotation) viewed from the obverse side of the watch to indicate the next number. Further, in the case in which the second index 13 indicates the number of 31, the second index 13 is rotated clockwise to indicate the number of 1 after passing through the position of indicating the number of 0 with fast-forwarding as shown in FIG. 6.

Figure 7:
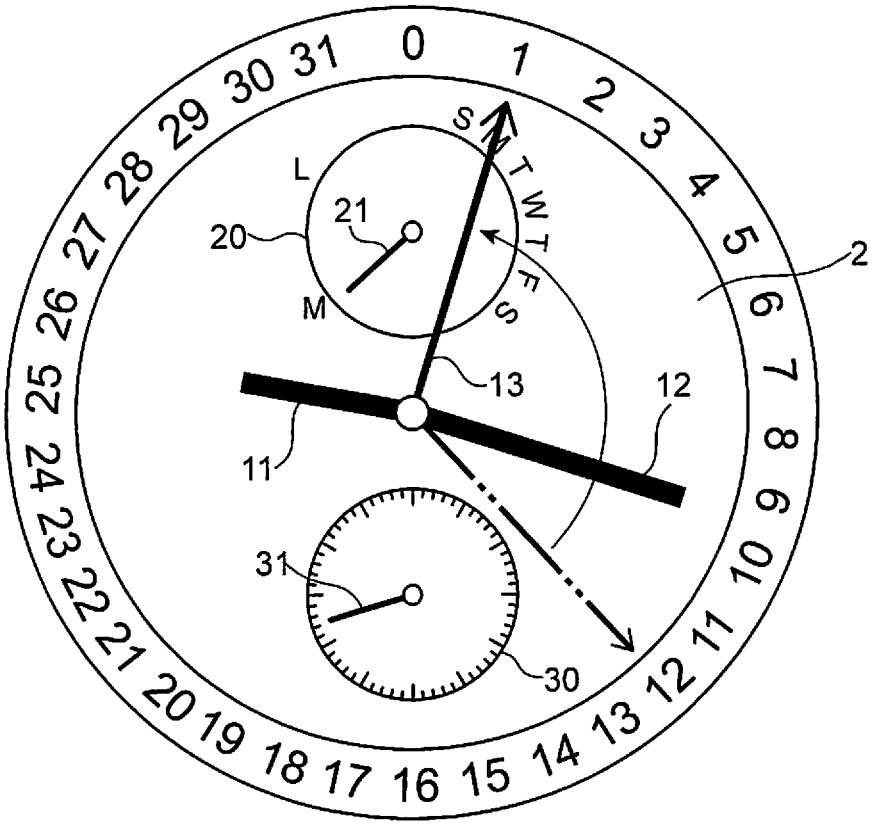
FIG. 7 is a diagram showing another movement example of the second index in the first embodiment.

Then, there will be described the case in which the first index 21 indicates the character "M" representing the month to thereby indicate the fact that the type of the calendar information is the month. In this case, in the case in which the second index 13 indicates either of the numbers of 1 through 11, the second index 13 is rotated clockwise to indicate the next number. Further, in the case in which the second index 13 indicates the number of 12, the second index 13 is rotated counterclockwise (reverse rotation) to indicate the number of 1 after passing through the positions of indicating the numbers of 2 through 11 as shown in FIG. 7. According to this operation, the movement length of the second index 13 can be shortened compared to the case of rotating the second index 13 clockwise to indicate the number of 1 after passing through the positions of indicating the numbers of 13 through 31 and 0. In such a manner, the movement range of the second index 13 is limited to the inside of the range indicating the numbers of 1 through 12.

Figure 8:
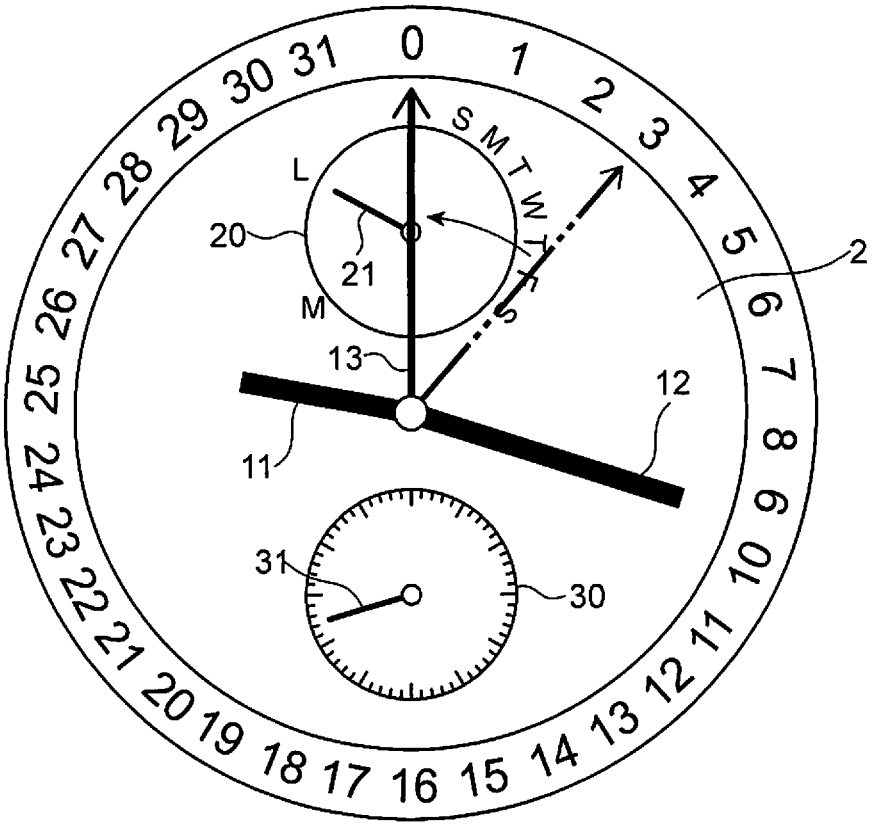
FIG. 8 is a diagram showing still another movement example of the second index in the first embodiment.

Then, there will be described the case in which the first index 21 indicates the character "L" representing the elapsed years to thereby indicate the fact that the type of the calendar information is the elapsed years. In this case, in the case in which the second index 13 indicates either of the numbers of 0 through 2, the second index 13 is rotated clockwise to indicate the next number. Further, in the case in which the second index 13 indicates the number of 3, the second index 13 is rotated counterclockwise to indicate the number of 0 after passing through the positions of indicating the numbers of 1 and 2 as shown in FIG. 8. According to this operation, the movement length of the second index 13 can be shortened compared to the case of rotating the second index 13 clockwise to indicate the number of 0 after passing through the positions of indicating the numbers of 4 through 31. In such a manner, the movement range of the second index 13 is limited to the range indicating the numbers of 0 through 3.

Functions and Advantages of First Embodiment

When the user operates the button 4 to make the first index 21 indicate one of the types of the calendar information, the second index 13 indicates the value of the calendar information of the type indicated by the first index 21. Thus, it is possible for the user to check the calendar information based on the type of the calendar information indicated by the first index 21 and the value of the calendar information indicated by the second index 13. Further, it is possible for the user to check the day information, the month information, and the elapsed-year information by operating the button 4 to switch the type of the calendar information indicated by the first index 21. In other words, the user can immediately check the calendar information of the type the user wants to check by operating the button 4.

Further, since it is sufficient for the second index 13 to indicate the values (0 through 31) of the calendar information, the intervals of the indication positions of the second index 13 can be increased, and the calendar information can be displayed in an easy-to-understand manner compared to the case in which, for example, the second index 13 indicates symbols or a scale representing the $1^{st}$ through $31^{st}$ days, symbols or a scale representing January through December, and symbols or a scale representing 0 through 3 years to thereby indicating the day information, the month information, and the elapsed-year information only with the second index 13.

Out of the numbers 0 through 31, the second index 13 indicates either of the numbers 1 through 31 in the case in which the first index 21 indicates the day, indicates either of the numbers 1 through 12 in the case in which the first index 21 indicates the month, or indicates either of the numbers 0 through 3 in the case in which the first index 21 indicates the elapsed years. Therefore, it is possible for the second index 13 to indicate the value of the day information, the value of the month information, and the value of the elapsed-year information by indicating the 32 values of 0 through 31.

The first index 21 indicates the day of the week to thereby indicate the fact that the type of the calendar information is the day. Therefore, it is possible for the user to check the day of the week, and at the same time check the fact that the type of the calendar information is the day by the first index 21 indicating the day of the week, and to check the day information based on the value indicated by the second index 13. Thus, it is possible to make the analog electronic watch 1 easier to use. Further, since there is no need to separately provide a dedicated index to the indication of the day of the week in addition to the first index 21 and the second index 13, the number of the indexes provided to the analog electronic watch 1 can be decreased compared to the case of separately providing the dedicated index. Thus, the number of step motors and gears can also be reduced.

The movement range of the second index 13 is limited to the range of indicating the numbers 1 through 12 in the case in which the first index 21 indicates the month, or is limited to the range of indicating the numbers 0 through 3 in the case in which the first index 21 indicates the elapsed years. Therefore, as described above, the movement length of the second index 13 can be decreased when the value of the calendar information stored in the calendar information storage section 57 is updated, and the second index 13 moves, and when the second index 13 moves in the calendar information setting mode. Thus, the power consumption of the analog electronic watch 1 can be reduced, and further, the setting of the values of the calendar information can promptly be performed.

Second Embodiment

Figure 9:
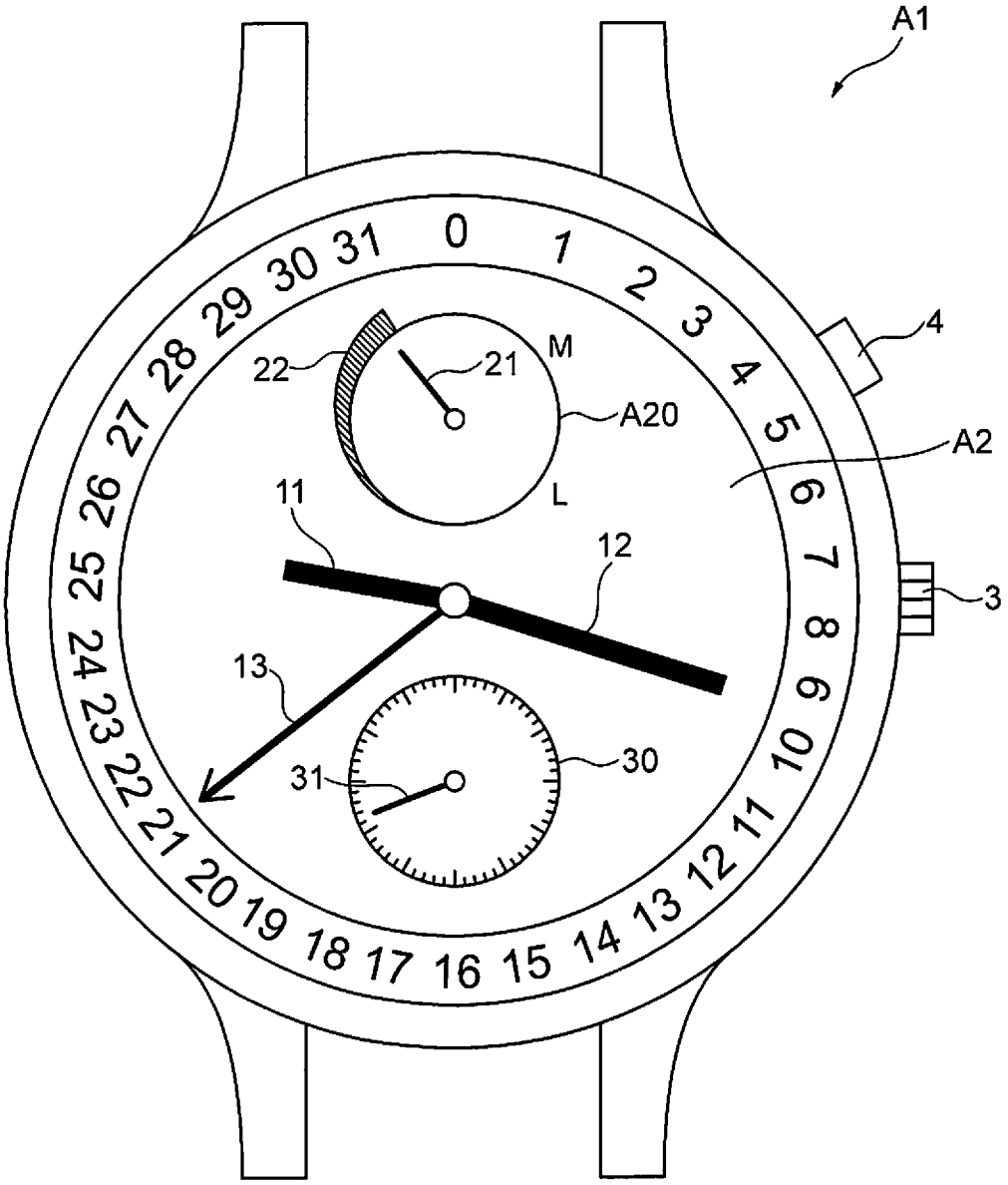
FIG. 9 is a front view of an analog electronic watch according to a second embodiment of the invention.

FIG. 9 is a front view showing an analog electronic watch A1.

As shown in FIG. 9, the analog electronic watch A1 is provided with a dial plate A2 having a circular shape. The dial plate A2 is provided with a first small window A20 having a circular shape and located at a position shifted toward the 12 o'clock direction from the center, and the second small window 30 having a circular shape and located at the position shifted toward the 6 o'clock direction from the center viewed from the obverse side of the watch.

Further, the analog electronic watch A1 is provided with the hour hand 11, the minute hand 12, the second hand 31, and the second index 13 similarly to the analog electronic watch 1 according to the first embodiment. Further, on the outer peripheral surface of the dial plate A2, there are displayed the numbers of 0 through 31 similarly to the analog electronic watch 1.

Further, the analog electronic watch A1 is provided with the first index 21 disposed in the first small window A20. Further, in the periphery of the first small window A20, there is displayed a symbol 22 having a crescent sickle-like shape, which is thick in an end portion (a tip end) in the direction toward the 11 o'clock position, and is thin in an end portion (a base end) in the direction toward the 7 o'clock position, from the vicinity of the 7 o'clock position of the first small window A20 through the vicinity of the 11 o'clock position thereof. The symbol 22 is a power indicator of a secondary cell 5 (see FIG. 10). Further, in the periphery of the first small window A20, the character of "M" representing the month is displayed in the vicinity of the 2 o'clock position of the first small window A20, and the character of "L" representing the elapsed years is displayed in the vicinity of the 4 o'clock position.

The first index 21 indicates the position corresponding to an amount of charge (a remaining battery level) of the secondary cell 5 in the symbol 22 to thereby indicate the amount of the charge. Further, the first index indicates the type of the calendar information. Specifically, the first index 21 indicates the symbol 22 to thereby indicate the charge amount, and at the same time indicate the fact that the type of the calendar information is the day. Further, the first index 21 indicates the character "M" to thereby indicate the fact that the type of the calendar information is the month. Further, the first index 21 indicates the character "L" to thereby indicate the fact that the type of the calendar information is the elapsed years.

Further, the analog electronic watch A1 is provided with the crown 3 and the button 4.

Figure 10:
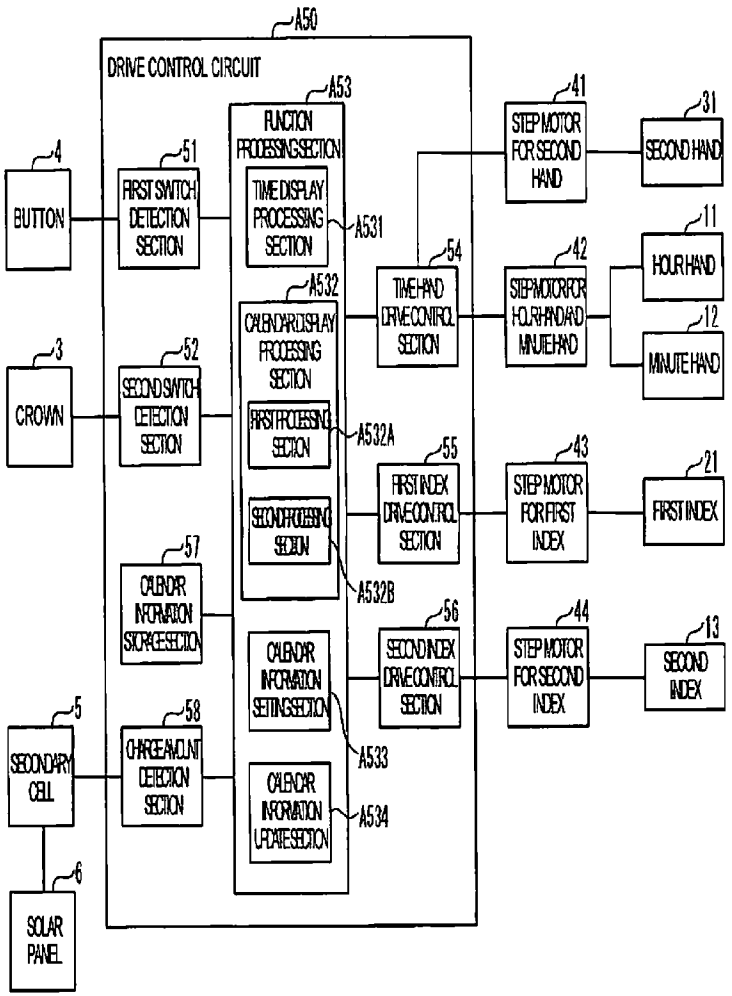
FIG. 10 is a block diagram showing a configuration of the analog electronic watch according to the second embodiment.

FIG. 10 is a block diagram showing a configuration of the analog electronic watch A1.

As shown in FIG. 10, the indexes 11 through 13, 21, and 31 are respectively driven by the four step motors 41 through 44 similarly to the analog electronic watch 1 according to the first embodiment.

Further, the analog electronic watch A1 is provided with a solar panel 6 as a power-generator device, and the secondary cell 5 in which the electric energy generated in the solar panel 6 is charged. The secondary cell 5 constitutes a power supply of the analog electronic watch A1.

The analog electronic watch A1 incorporates a drive control circuit A50.

The drive control circuit A50 is provided with the first switch detection section 51, the second switch detection section 52, a function processing section A53, the time hand drive control section 54, the first index drive control section 55, the second index drive control section 56, the calendar information storage section 57, and a charge amount detection section 58.

The charge amount detection section 58 detects the amount of the charge (the remaining battery level) of the secondary cell 5. The detection of the charge amount is performed at, for example, regular time intervals.

The function processing section A53 is provided with a time display processing section A531, a calendar display processing section A532, a calendar information setting section A533, and a calendar information update section A534.

The time display processing section A531, the calendar information setting section A533, and the calendar information update section A534 have substantially the same functions as those of the time display processing section 531, the calendar information setting section 533, and the calendar information update section 534 of the analog electronic watch 1 according to the first embodiment.

The calendar display processing section A532 is provided with a first processing section A532A and a second processing section A532B.

The first processing section A532A controls the step motor 43 for the first index to thereby control the movement of the first index 21.

Specifically, when the button 4 is pushed in, and the detection signal is input from the first switch detection section 51, the first processing section A532A moves the first index 21 to make the first index 21 indicate the type of the calendar information and the charge amount detected by the charge amount detection section 58 in a switching manner.

Here, when the first processing section A532A makes the first index 21 indicate the fact that the type of the calendar information is the day, the first processing section A532A makes the first index 21 indicate the symbol 22 to indicate the charge amount detected by the charge amount detection section 58.

The second processing section A532B controls the step motor 44 for the second index to thereby control the movement of the second index 13.

Specifically, when the type of the calendar information to be indicated by the first index 21 has been switched, the second processing section A532B makes the second index 13 indicate the number corresponding to the value of the type of the calendar information to be indicated by the first index 21 out of the calendar information stored in the calendar information storage section 57 to thereby indicate the value of the calendar information.

Calendar Information Setting Process

Then, the setting process of the calendar information stored in the calendar information storage section 57 will be described.

When the crown 3 is pulled out, the function processing section A53 makes the transition to the calendar information setting mode. When the button 4 is held down in this state, the first processing section A532A moves the first index 21 to sequentially indicate the symbol 22, the character "M" representing the month, and the character "L" representing the elapsed years. Further, when the crown 3 is rotationally operated, the second processing section A532B moves the second index 13.

Then, when the crown 3 is rotationally operated to move the second index 13 and then the crown 3 is pushed in in the state in which the first index 21 indicates the symbol 22, the calendar information setting section A533 sets the value of the number indicated by the second index 13 as the value of the day information of the calendar information storage section 57.

Further, when the crown 3 is rotationally operated to move the second index 13 and then the crown 3 is pushed in in the state in which the first index 21 indicates the character "M" representing the month, the calendar information setting section A533 sets the value of the number indicated by the second index 13 as the value of the month information of the calendar information storage section 57.

Further, when the crown 3 is rotationally operated to move the second index 13 and then the crown 3 is pushed in in the state in which the first index 21 indicates the character "L" representing the elapsed years, the calendar information setting section A533 sets the value of the number indicated by the second index 13 as the value of the elapsed-year information of the calendar information storage section 57.

Then, when the crown 3 is pushed in as described above, the function processing section A53 makes the transition to the normal mode.

Calendar Display Process

Then, the calendar display process performed by the calendar display processing section A532 will be described.

Figure 11:
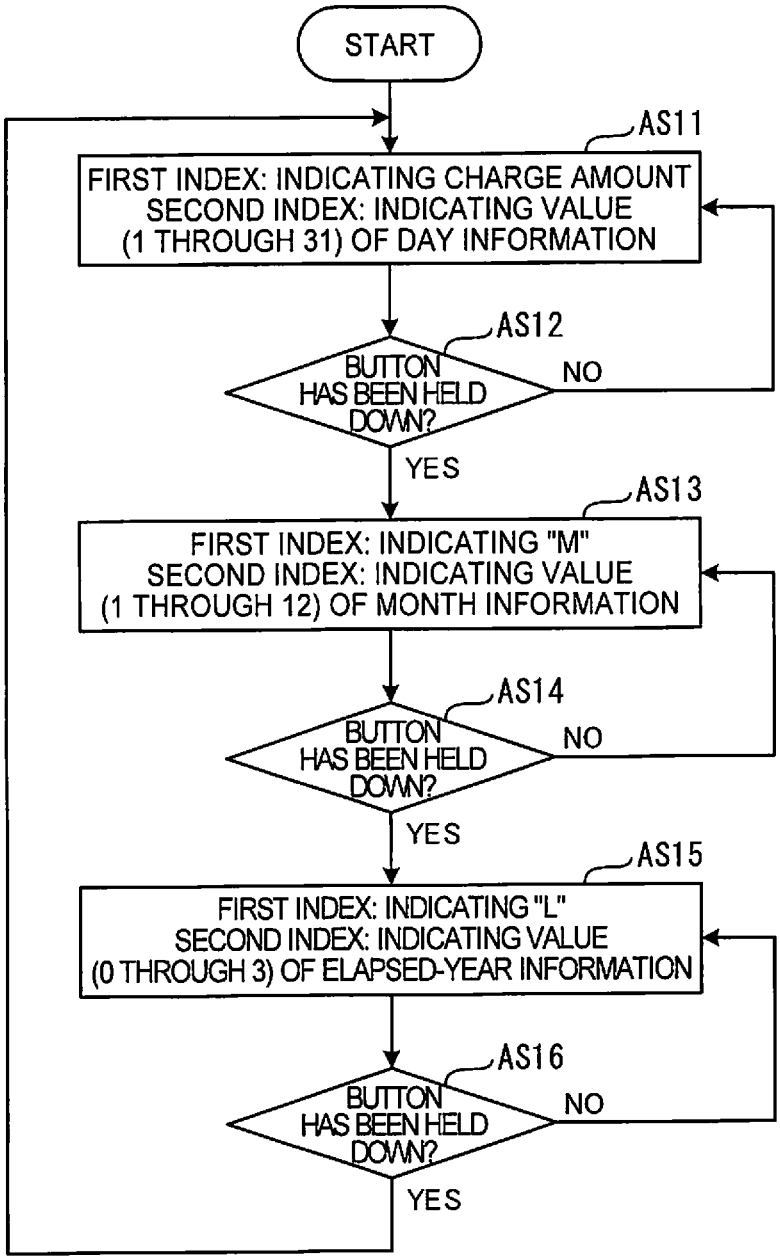
FIG. 11 is a flowchart showing a calendar display process in the second embodiment.

FIG. 11 is a flowchart showing the calendar display process. The calendar display process is performed while the function processing section A53 is in the normal mode.

When the calendar display process is performed, the first processing section A532A moves the first index 21 to indicate the position corresponding to the charge amount in the symbol 22 to thereby indicate the charge amount as shown in FIG. 9. Further, thus, the first processing section A532A makes the first index 21 indicate the fact that the type of the calendar information is the day. Further, the second processing section A5328 moves the second index 13 to indicate the number corresponding to the value (1 through 31) of the day information stored in the calendar information storage section 57 to thereby indicate the value of the day information. Due to these operations, the day information is displayed (AS11). It should be noted that this display state corresponds to a display state in the normal period.

Then, the calendar display processing section A532 determines whether or not the detection signal is input from the first switch detection section 51 to thereby determine (AS12) whether or not the button 4 has been held down.

In the case in which the determination of NO has been made in the step AS12, the first processing section A532A and the second processing section A532B continue the process of the step AS11. It should be noted that in the case in which the time has passed while the state of YES is not determined in the step AS12, and the value of the day information stored in the calendar information storage section 57 has been updated, the second processing section A532B moves the second index 13 to indicate the value of the day information having been updated.

Figure 12:
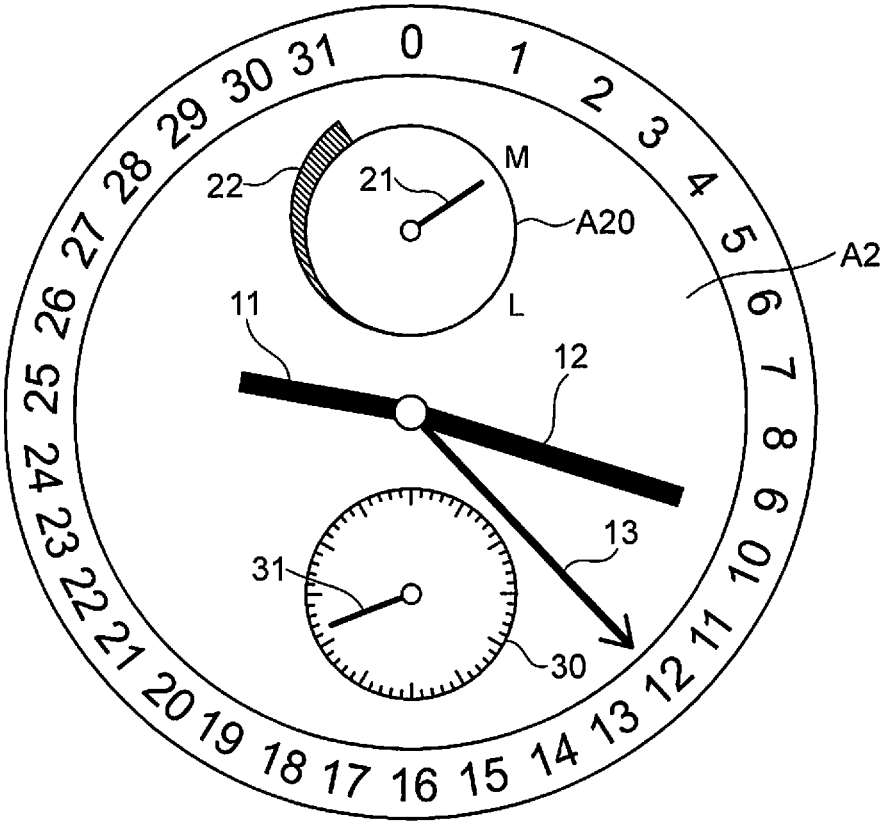
FIG. 12 is a diagram showing a display example of the analog electronic watch according to the second embodiment.

On the other hand, in the case in which the determination of YES has been made in the step AS12, the first processing section A532A moves the first index 21 to indicate the character "M" representing the month, and thus indicate the fact that the type of the calendar information is the month as shown in FIG. 12. Further, the second processing section A532B moves the second index 13 to indicate the number corresponding to the value (1 through 12) of the month information stored in the calendar information storage section 57 to thereby indicate the value of the month information. Due to these operations, the month information is displayed (AS13).

Then, the calendar display processing section A532 determines (AS14) whether or not the detection signal has been input from the first switch detection section 51.

In the case in which the determination of NO has been made in the step AS14, the first processing section A532A and the second processing section A532B continue the process of the step AS13. It should be noted that in the case in which the time has passed while the state of YES is not determined in the step AS14, and the value of the month information stored in the calendar information storage section 57 has been updated, the second processing section A532B moves the second index 13 to indicate the value of the month information having been updated.

Figure 13:
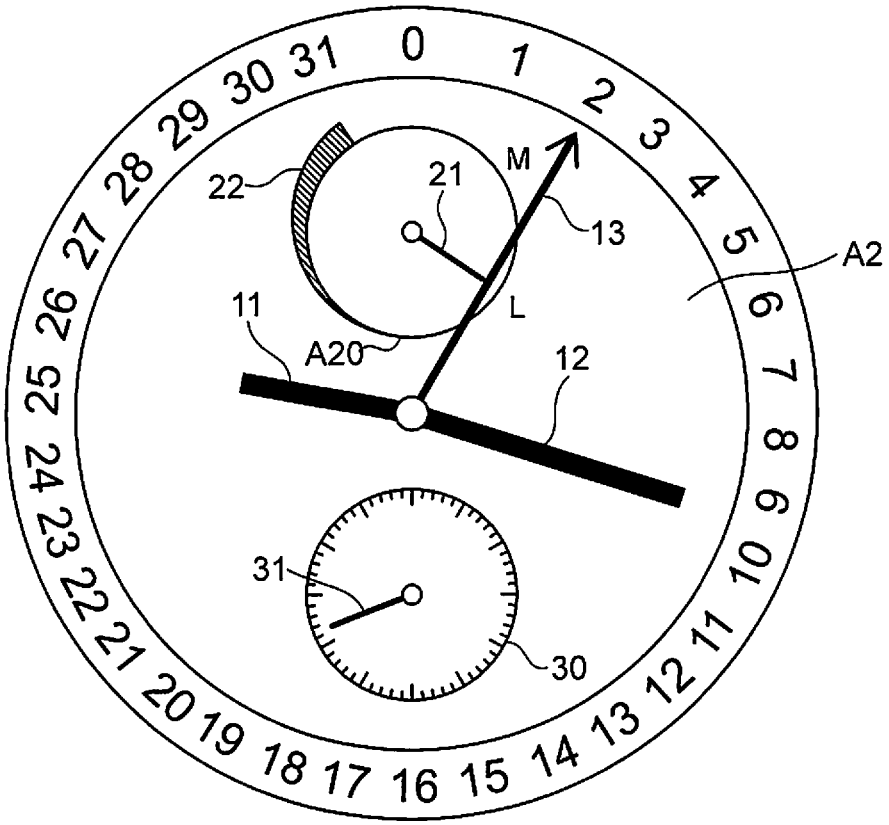
FIG. 13 is a diagram showing another display example of the analog electronic watch according' to the second embodiment.

On the other hand, in the case in which the determination of YES has been made in the step AS14, the first processing section A532A moves the first index 21 to indicate the character "L" representing the elapsed years, and thus indicate the fact that the type of the calendar information is the elapsed years as shown in FIG. 13. Further, the second processing section A532B moves the second index 13 to indicate the number corresponding to the value (0 through 3) of the elapsed-year information stored in the calendar information storage section 57 to thereby indicate the value of the elapsed-year information. Due to these operations, the elapsed-year information is displayed (AS15).

Then, the calendar display processing section A532 determines (AS16) whether or not the detection signal has been output from the first switch detection section 51.

In the case in which the determination of NO has been made in the step AS16, the first processing section A532A and the second processing section A532B continue the process of the step AS15. It should be noted that in the case in which the time has passed while the state of YES is not determined in the step AS16, and the value of the elapsed-year information stored in the calendar information storage section 57 has been updated, the second processing section A532B moves the second index 13 to indicate the value of the elapsed-year information having been updated.

On the other hand, in the case in which the determination of YES has been made in the step AS16, the calendar display processing section A532 returns the process to the step AS11, and then repeatedly performs the processes of the steps AS11 through AS16.

Functions and Advantages of Second Embodiment

The analog electronic watch A1 according to the second embodiment can obtain substantially the same functions and advantages with substantially the same configuration as that of the analog electronic watch 1 according to the first embodiment.

Further, in the case in which the first index 21 indicates the charge amount, the second index 13 indicates the value of the day information. Therefore, it is possible for the user to check the charge amount, and at the same time check the fact that the type of the calendar information is the day by the first index 21 indicating the charge amount, and to check the day information based on the value indicated by the second index 13. Therefore, since the user can always check the value of the day and the charge amount by keeping the first index indicating the charge amount, it is possible to make the analog electronic watch A1 easier to use.

Further, since the indication of the charge amount is performed by the first index 21 for indicating the type of the calendar information, there is no need to separately provide a dedicated index to the indication of the charge amount, the number of the indexes provided to the analog electronic watch A1 can be decreased compared to the case of separately providing the dedicated index. Thus, the number of step motors and gears can also be reduced.

Third Embodiment

In an analog electronic watch according to a third embodiment, the first processing section A532A makes the first index 21 indicate the charge amount in the case in which the charge amount detected by the charge amount detection section 58 becomes lower than a threshold value set in advance. The rest of the configuration is the same as that of the analog watch A1 according to the second embodiment.

Figure 14:
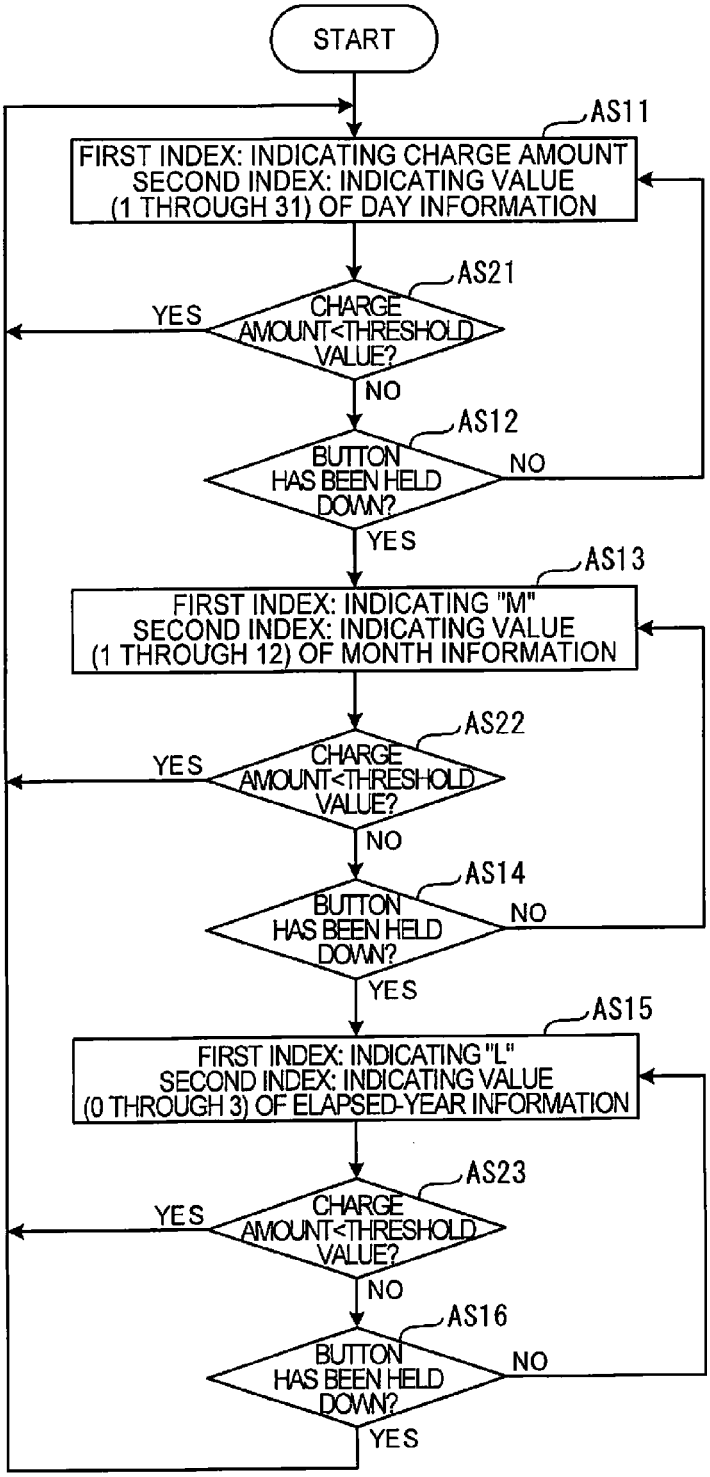
FIG. 14 is a flowchart showing a calendar display process according to a third embodiment of the invention.

FIG. 14 is a flowchart showing the calendar display process in the third embodiment. Here, the steps AS11 through AS16 are the same as those of the calendar display process of the second embodiment, and therefore, the explanation thereof will be omitted.

In the calendar display process of the second embodiment, after the process of the step AS11, the first processing section A532A determines whether or not the charge amount detected by the charge amount detection section 58 is lower than the threshold value set in advance, and then makes the process proceed to the step AS12 in the case in which the state of NO has been determined, or returns the process to the step AS11 in the case in which the determination of YES has been made (AS21).

Similarly, after the process of the step AS13, the first processing section A532A determines whether or not the charge amount is lower than the threshold value, and then makes the process proceed to the step AS14 in the case in which the state of NO has been determined, or returns the process to the step AS11 in the case in which the determination of YES has been made (AS22). Further, after the process of the step AS15, whether or not the charge amount is lower than the threshold value is determined, and the process proceeds to the step AS16 in the case in which the state of NO has been determined, or the process is returned to the step AS11 in the case in which the determination of YES has been made (AS23).

According to this operation, even in the case in which the first index 21 indicates the character "M" representing the month or the character "L" representing the elapsed years, if the charge amount becomes lower than the threshold value, the determination of YES is made in the steps AS22 and AS23, the process returns to the step AS11, the first index 21 indicates the charge amount, and the second index 13 indicates the value of the day information.

Further, in the case in which the charge amount becomes lower than the threshold value in the state in which the first index 21 indicates the charge amount, since the state of YES is always determined in the step AS21, and the processes of the steps AS11, AS21 are repeated, even if the button 4 is held down, the first index 21 continuously indicates the charge amount.

It should be noted that the process of the step AS21 can also be eliminated. In this case, in the case in which the charge amount becomes lower than the threshold value in the state in which the first index 21 indicates the charge amount, if the button 4 is held down, the month information is displayed in the step AS13. Then, immediately afterwards, the determination of YES is made in the step AS22, the process returns to the step AS11, and the first index 21 indicates the charge amount.

Functions and Advantages of Third Embodiment

Even in the case in which the first index 21 does not indicate the charge amount, if the charge amount of the secondary cell 5 drops to a level lower than the threshold value, the first index 21 automatically indicates the charge amount, and therefore, the user can check the fact that the charge amount has dropped. Thus, it is possible to surely inform the user of the fact that the charge amount of the secondary cell 5 has dropped to thereby reduce the possibility that the charge fails to occur to cause a system failure.

Fourth Embodiment

An analog electronic watch A1A according to a fourth embodiment is provided with an alarm function as an additional function other than the calendar display function.

Figure 15:
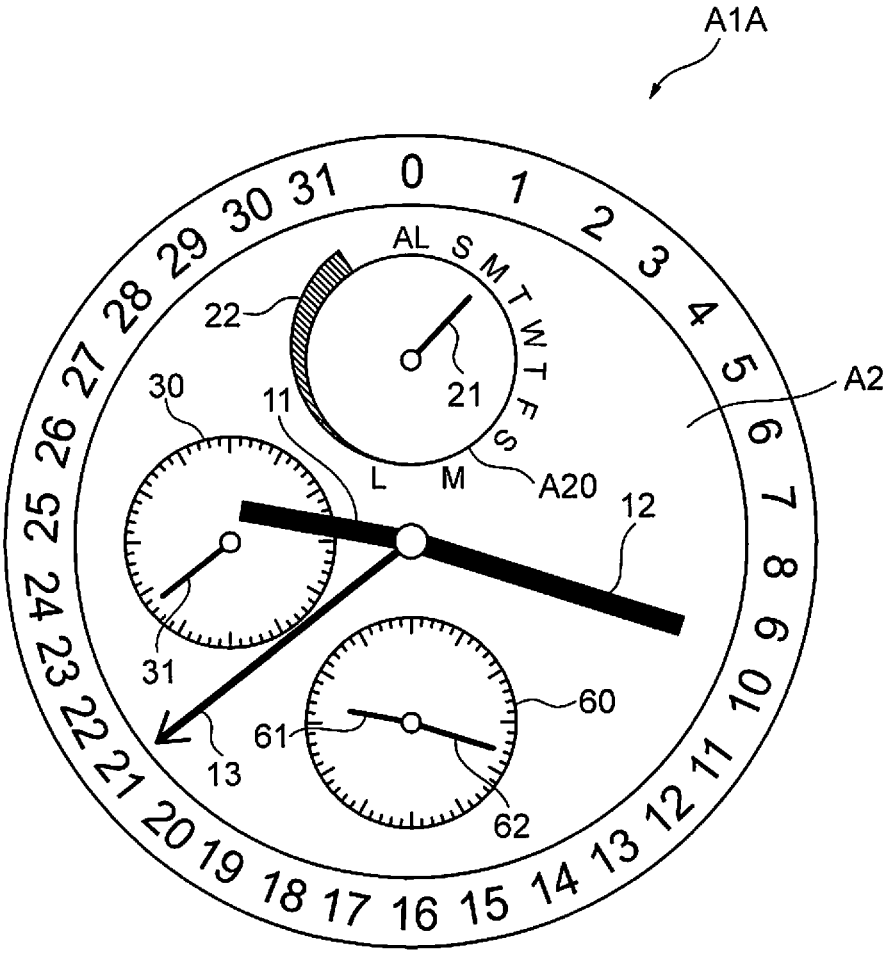
FIG. 15 is a front view of an analog electronic watch according to a fourth embodiment of the invention.

FIG. 15 is a front view showing the analog electronic watch A1A. It should be noted that the same constituents as those of the analog electronic watch A1 according to the second embodiment are provided with the same reference symbols, and the explanation thereof will be omitted.

In the analog electronic watch A1A, in the periphery of the first small window A20, the character of "M" representing the month is displayed in the vicinity of the 5 o'clock position of the first small window A20, and the character of "L" representing the elapsed years is displayed in the vicinity of the 7 o'clock position of the first small window A20. Further, the characters of "S," "M," "T," "W," "T," "F," and "S" respectively representing the seven days of the week of Sunday through Saturday are displayed in the vicinity of the 1 o'clock position through the vicinity of the 4 o'clock position of the first small window A20. Further, in the vicinity of the 12 o'clock position of the first small window A20, there are displayed characters of "AL" representing the alarm function.

The first index 21 indicates one of the characters "S" through "S" representing the seven days of the week to thereby indicate the day of the week.

Further, the first index 21 indicates the type of the additional function other than the calendar display function. In the present embodiment, the first index 21 indicates the characters "AL" to thereby indicate the alarm function.

Further, the first index 21 indicates either of the symbol 22 and the characters "S" through "S" and "AL" to thereby indicate the fact that the type of the calendar information is the day.

Further, in the analog electronic watch A1A, the second small window 30 is disposed at a position shifted toward the 9 o'clock direction from the center of the dial plate A2. Further, at the position shifted toward the 6 o'clock direction from the center of the dial plate A2, there is disposed a third small window 60 having a circular shape.

Further, in the third small window 60, there are disposed a first function hand 61 and a second function hand 62. The function hands 61, 62 respectively indicate the hour and the minute of the alarm time. The first function hand 61 indicates the hour of the alarm time, and the second function hand 62 indicates the minute of the alarm time. Here, the function hands 61, 62 each constitute a third index according to the invention.

Figure 16:
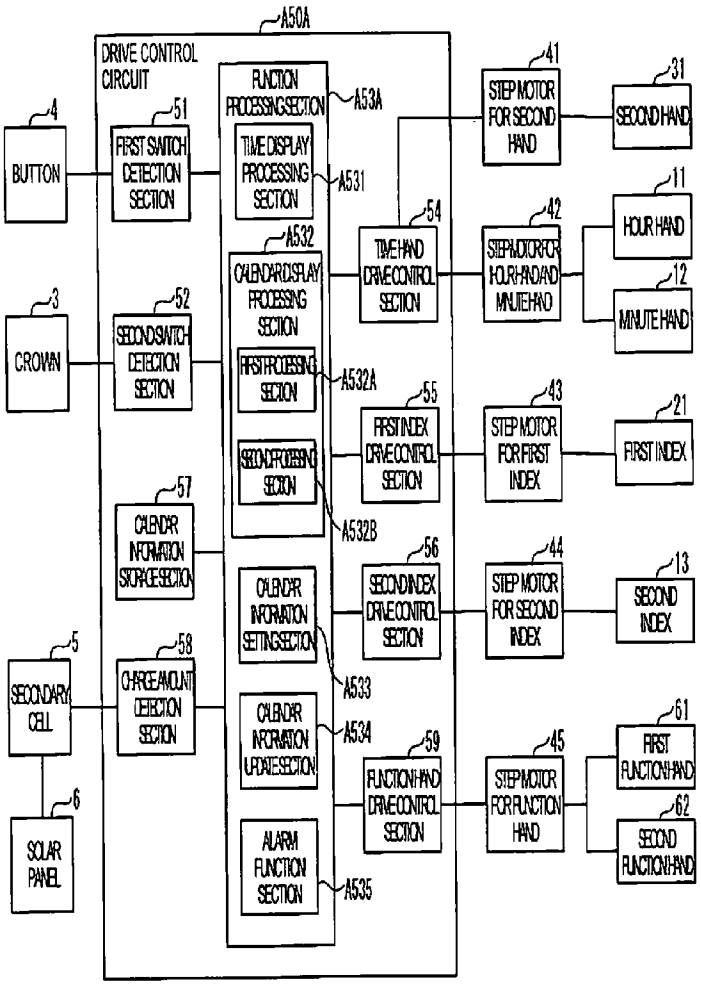
FIG. 16 is a block diagram showing a configuration of the analog electronic watch according to the fourth embodiment.

FIG. 16 is a block diagram showing a configuration of the analog electronic watch A1A.

As shown in FIG. 16, the function hands 61, 62 are driven by a step motor 45 for the function hands. Further, a drive control circuit A50A is provided with a function hand drive control section 59, and the function hand drive control section 59 outputs a motor drive pulse using the reference signal output from the reference signal generation circuit to control the step motor 45 for the function hands to thereby control the drive of the function hands 61, 62.

In the analog electronic watch A1A, when the button 4 is held down, the first processing section A532A moves the first index 21 to make the first index 21 indicate the days of the week, the character "M" representing the month, the character "L" representing the elapsed years, the charge amount, and the characters "AL" representing the alarm function in a switching manner.

It should be noted that the first processing section A532A makes the first index 21 indicate the character corresponding to the day-of-the-week information stored in the calendar information storage section 57 out of the characters "S" through "S" representing the seven days of the week to thereby indicate the clay of the week.

Further, the function processing section A53A of the analog electronic watch A1A is provided with an alarm function section A535.

When the current time reaches the alarm time set in advance, the alarm function section A535 detects the fact that the current time has reached the alarm time, and then informs the user of the fact using a sounding device not shown provided to the analog electronic watch A1A.

Further, the alarm function section A535 controls the step motor 45 for the function hands to thereby control the movement of the function hands 61, 62.

Specifically, in the case in which the first index 21 indicates the characters "AL," the alarm function section A535 makes the function hands 61, 62 indicate the hour and the minute of the alarm time set in advance. It should be noted that in the case in which the first index 21 indicates characters or symbols other than the characters "AL," the time display processing section A531 makes the function hands 61, 62 indicate the hour and the minute of the current time.

It should be noted that the alarm time can be set by, for example, making the first index 21 indicate the characters "AL," and then rotationally operating the crown 3 to make the function hands 61, 62 indicate predetermined time in this state.

Calendar Display Process

Figure 17:
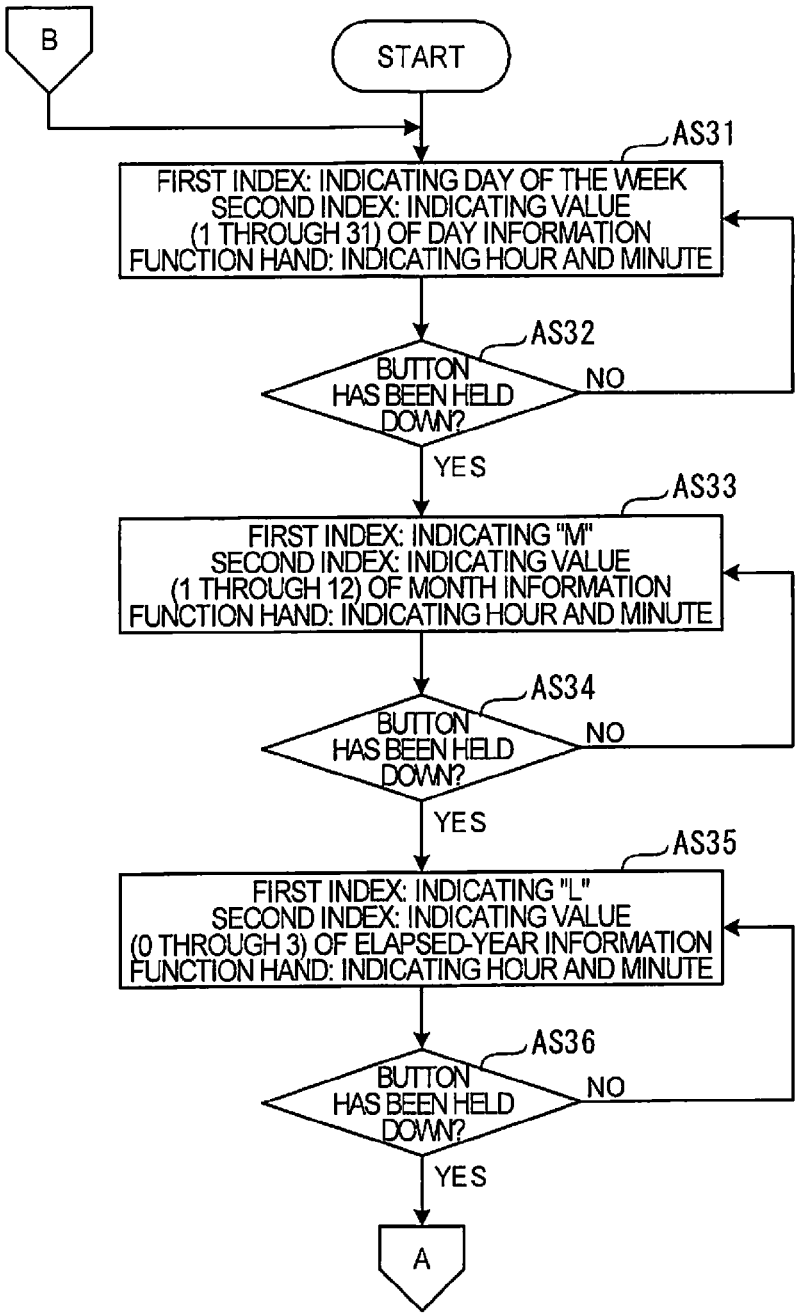
FIG. 17 is a flowchart showing a calendar display process in the fourth embodiment.
Figure 18:
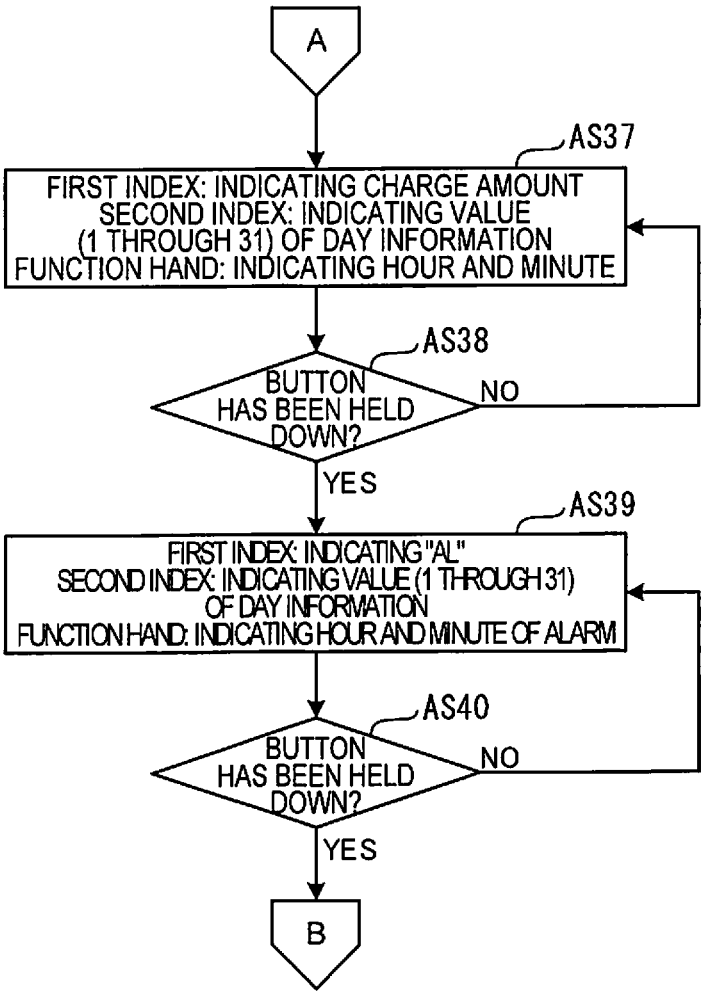
FIG. 18 is a flowchart showing the calendar display process in the fourth embodiment.

FIGS. 17 and 18 are flowcharts showing a calendar display process in the fourth embodiment.

When the calendar display process is performed, the first processing section A532A moves the first index 21 to indicate the character corresponding to the day-of-the-week information stored in the calendar information storage section 57 out of the characters "S" through "S" representing the seven days of the week to thereby indicate the day of the week. Further, thus, the first processing section A532A makes the first index 21 indicate the fact that the type of the calendar information is the day. Further, the second processing section A532B moves the second index 13 to indicate the number corresponding to the value of the day information stored in the calendar information storage section 57 to thereby indicate the value of the day information. Further, the time display processing section A531 makes the function hands 61, 62 indicate (AS31) the hour and the minute of the current time. It should be noted that this display state corresponds to a display state in the normal period.

Then, the function processing section A53A determines (AS32) whether or not the button 4 has been held down. In the case in which the determination of NO has been made in the step AS32, the function processing section A53A returns the process to the step AS31.

In the case in which the determination of YES has been made in the step AS32, the first processing section A532A moves the first index 21 to indicate the character "M" representing the month. Further, the second processing section A532B moves the second index 13 to indicate (AS33) the number corresponding to the value of the month information stored in the calendar information storage section 57.

Then, the function processing section A53A determines (AS34) whether or not the button 4 has been held down. In the case in which the determination of NO has been made in the step AS34, the function processing section A53A returns the process to the step AS33.

In the case in which the determination of YES has been made in the step AS34, the first processing section A532A moves the first index 21 to indicate the character "L" representing the elapsed years. Further, the second processing section A532B moves the second index 13 to indicate (AS35) the number corresponding to the value of the elapsed-year information stored in the calendar information storage section 57.

Then, the function processing section A53A determines (AS36) whether or not the button 4 has been held down. In the case in which the determination of NO has been made in the step AS36, the function processing section A53A returns the process to the step AS35.

In the case in which the determination of YES has been made in the step AS36, the first processing section A532A moves the first index 21 to indicate the charge amount. Further, the second processing section A532B moves the second index 13 to indicate (AS37) the number corresponding to the value of the day information stored in the calendar information storage section 57.

Then, the function processing section A53A determines (AS38) whether or not the button 4 has been held down. In the case in which the determination of NO has been made in the step AS38, the function processing section A53A returns the process to the step AS37.

In the case in which the determination of YES has been made in the step AS38, the first processing section A532A moves the first index 21 to indicate the characters "AL" to thereby indicate the fact that the type of the additional function is the alarm function. Further, the second processing section A532B moves the second index 13 to indicate the number corresponding to the value of the day information stored in the calendar information storage section 57. Further, the alarm function section A535 makes the function hands 61, 62 indicate (AS39) the hour and the minute of the alarm time set in advance.

Then, the function processing section A53A determines (AS40) whether or not the button 4 has been held down, and then returns the process to the step AS39 in the case in which the determination of NO has been made, or returns the process to the step AS31, and then repeatedly performs the processes of the steps AS31 through AS40 in the case in which the determination of YES has been made.

Functions and Advantages of Fourth Embodiment

In the case in which the first index 21 indicates the day of the week, the second index 13 indicates the value of the day. Therefore, it is possible for the user to check the day of the week, and at the same time check the fact that the type of the calendar information is the day by the first index 21 indicating the day of the week, and to check the day information based on the value indicated by the second index 13. Thus, it is possible to make the analog electronic watch A1A easier to use. Further, since there is no need to separately provide a dedicated index to the indication of the day of the week, the number of the indexes provided to the analog electronic watch A1A can be decreased compared to the case of separately providing the dedicated index.

Further, by checking the fact that the first index 21 indicates the characters "AL," the user can confirm the fact that the function hands 61, 62 indicate the alarm time.

Further, since the second index 13 indicates the value of the day information while the first index 21 is indicating the characters "AL," the user can check the alarm time and the day information at the same time.

Fifth Embodiment

An analog electronic watch according to a fifth embodiment performs the following process in addition to the process of the analog electronic watch A1A according to the fourth embodiment. In other words, in the case in which the charge amount detected by the charge amount detection section 58 becomes lower than the threshold value set in advance, the first processing section A532A makes the first index 21 indicate the charge amount, and restricts the operation of the alarm function section A535.

Figure 19:
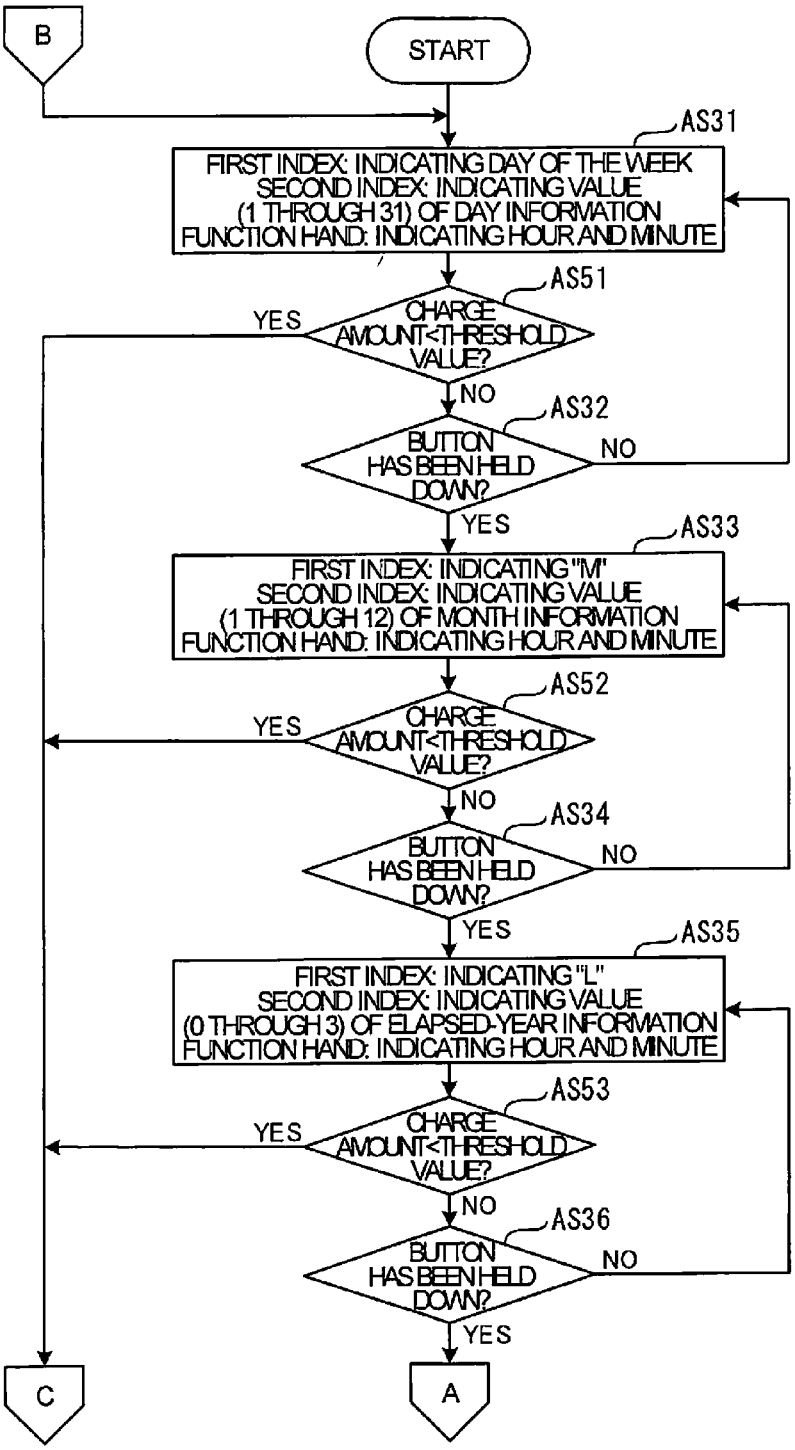
FIG. 19 is a flowchart showing a calendar display process according to a fifth embodiment of the invention.
Figure 20:
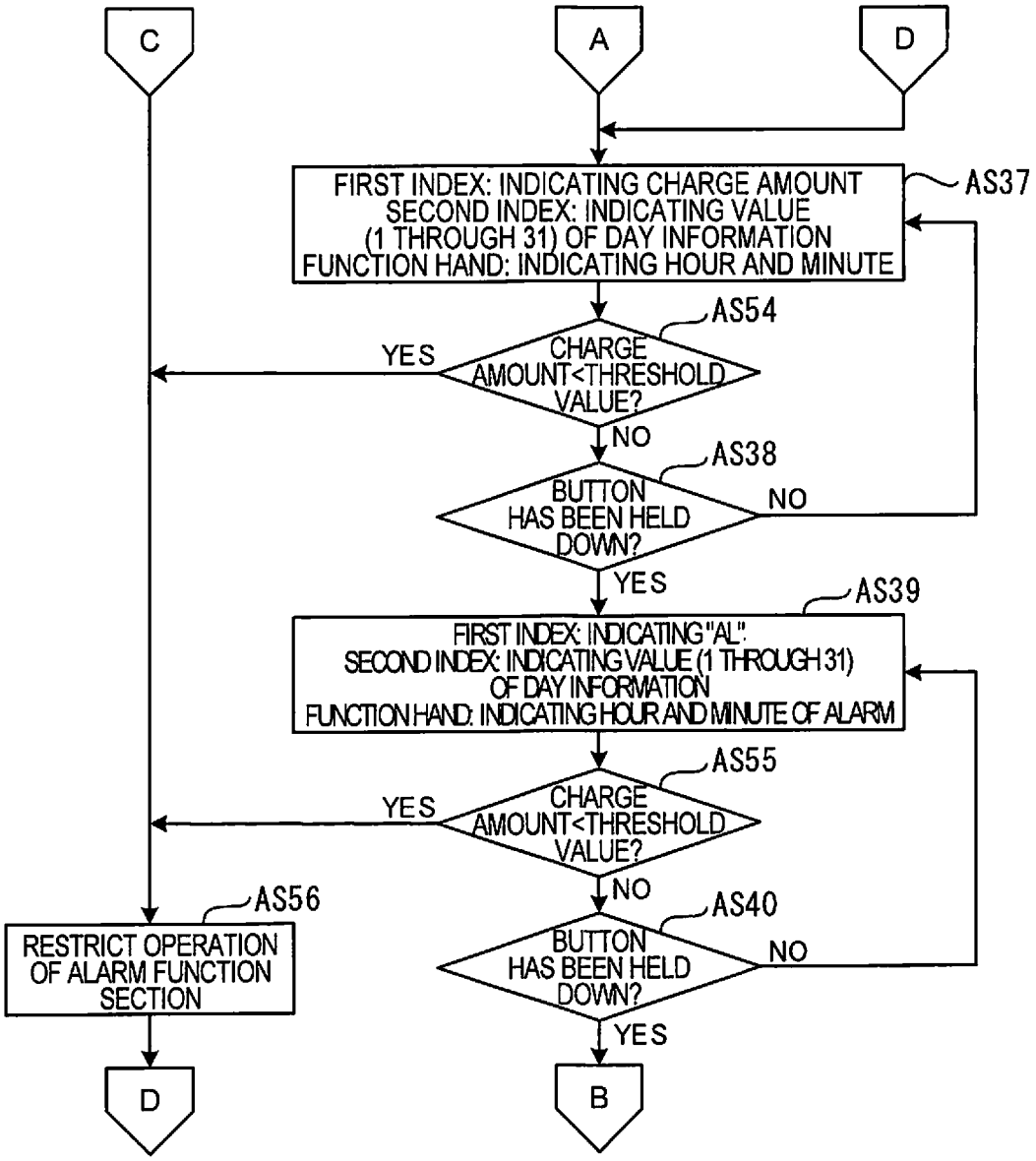
FIG. 20 is a flowchart showing a calendar display process in the fifth embodiment.

FIGS. 19 and 20 are flowcharts showing a calendar display process in the fifth embodiment. Here, the steps AS31 through AS40 are the same as those of the calendar display process of the fourth embodiment, and therefore, the explanation thereof will be omitted.

In the calendar display process of the fifth embodiment, the first processing section A532A determines whether or not the charge amount detected by the charge amount detection section 58 is lower than the threshold value set in advance after the process of the step AS31. Then, in the case in which the determination of NO has been made, the first processing section A532A makes the process proceed to the step AS32 to determine whether or not the button 4 has been held down. On the other hand, in the case in which the determination of YES has been made, the first processing section makes (AS51) the process proceed to the step AS56.

Further, the first processing section A532A also performs (AS52 through AS55) substantially the same determination after the processes of the steps AS33, AS35, AS37, and AS39.

In the step AS56, the first processing section A532A restricts the operation of the alarm function section A535. In other words, the first processing section A532A terminates the operation of the alarm function section A535 in the case in which the alarm function section A535 is in operation, or inhibits the alarm function section A535 from operating in the case in which the alarm function section A535 is not in operation. Further, the first processing section A532A makes the process proceed to the step AS37. Then, the first processing section A532A makes the first index 21 indicate the charge amount.

It should be noted that in the case in which the secondary cell 5 is charged, and the charge amount detected by the charge amount detection section 58 has become equal to or higher than the threshold value after restricting the operation of the alarm function section A535, the first processing section A532A remove the restriction.

Further, the process of the step AS54 can also be eliminated similarly to the process of the step AS21 of the third embodiment.

Functions and Advantages of Fifth Embodiment

Even in the case in which the first index 21 does not indicate the charge amount, if the charge amount of the secondary cell 5 drops to a level lower than the threshold value, the first index 21 automatically indicates the charge amount, and therefore, the user can check the fact that the charge amount has dropped. Thus, it is possible to surely inform the user of the fact that the charge amount of the secondary cell 5 has dropped to thereby reduce the possibility that the charge fails to occur to cause a system failure.

Further, since the execution of the alarm function is restricted if the charge amount drops to a level lower than the threshold value, the power consumption can be reduced compared to the case in which the restriction is not applied, and the possibility of the system failure can further be reduced. Further, the situation that the alarm function is not correctly performed can be prevented from occurring.

Sixth Embodiment

Figure 21:
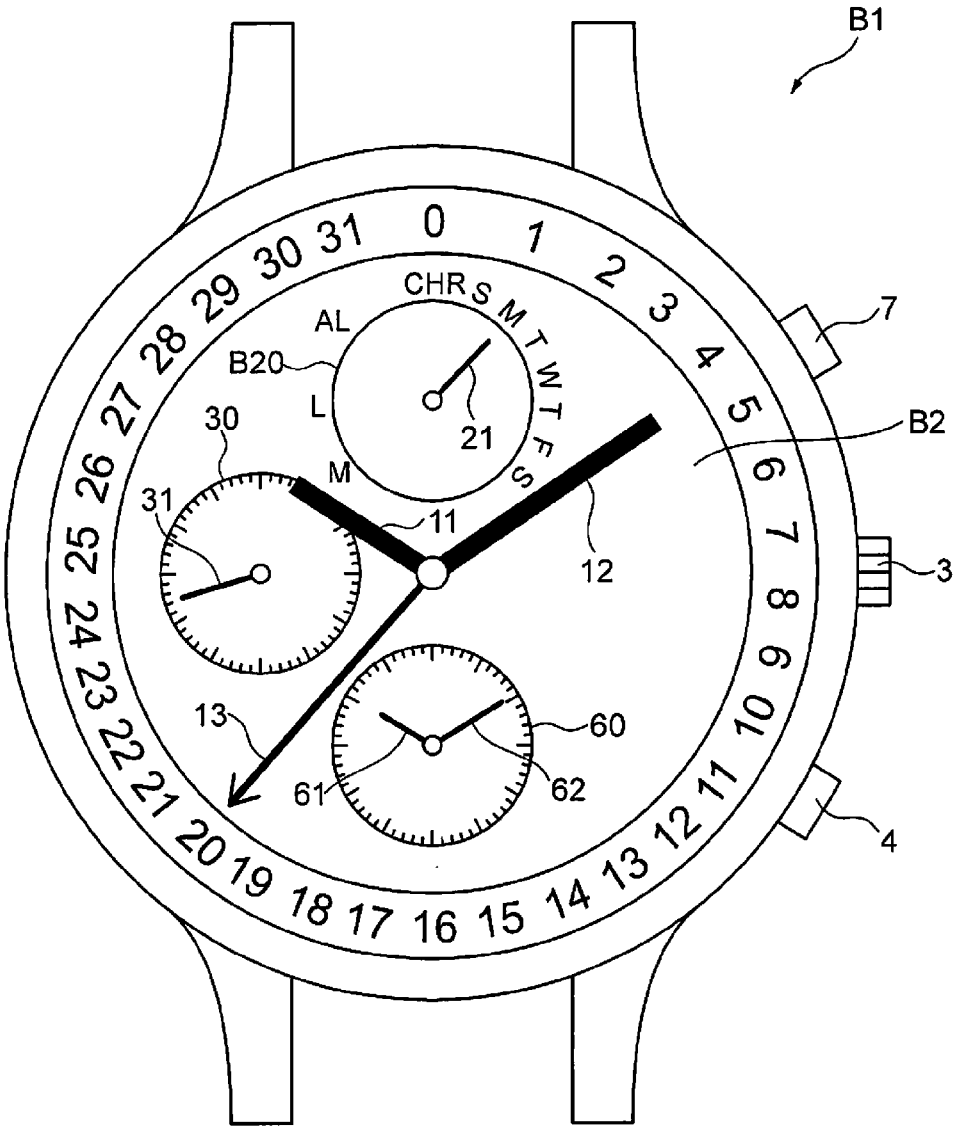
FIG. 21 is a front view of an analog electronic watch according to a sixth embodiment of the invention.

FIG. 21 is a front view showing an analog electronic watch B1.

As shown in FIG. 21, the analog electronic watch B1 is provided with a dial plate B2 having a circular shape. The dial plate B2 is provided with a first small window B20 having a circular shape and located at a position shifted toward the 12 o'clock direction from the center, the second small window 30 having a circular shape and located at the position shifted toward the 9 o'clock direction from the center, and the third small window 60 having a circular shape and located at the position shifted toward the 6 o'clock direction from the center viewed from the obverse side of the watch.

Further, the analog electronic watch B1 is provided with the hour hand 11, the minute hand 12, the second hand 31, and the second index 13 similarly to the analog electronic watch 1 according to the first embodiment. Further, on the outer peripheral surface of the dial plate B2, there are displayed the numbers of 0 through 31 similarly to the analog electronic watch 1.

Further, the analog electronic watch B1 is provided with the first index 21 disposed in the first small window B20. Further, in the periphery of the first small window B20, the characters of "S," "M," "T," "W," "T," "F," "S" respectively representing the seven days of the week of Sunday through Saturday are displayed in the vicinity of the 1 o'clock position through the vicinity of the 4 o'clock position of the first small window B20. Further, in the periphery of the first small window B20, the character of "M" representing the month is displayed in the vicinity of the 8 o'clock position of the first small window B20, the character of "L" representing the elapsed years is displayed in the vicinity of the 9 o'clock position, the characters of "AL" representing the alarm function are displayed in the vicinity of the 10 o'clock position, and characters of "CHR" representing a chronograph function are displayed in the vicinity of the 12 o'clock position.

The first index 21 indicates one of the characters "S" through "S" representing the seven days of the week to thereby indicate the day of the week.

Further, the first index 21 indicates the type of the additional functions other than the calendar display function. Specifically, the first index 21 indicates the characters "AL" to thereby indicate the alarm function. Further, the first index 21 indicates the characters "CHR" to thereby indicate the chronograph function.

Further, the first index 21 indicates the type of the calendar information. Specifically, the first index 21 indicates either of the characters "S" through "S," "AL," and "CHR" to thereby indicate the fact that the type of the calendar information is the day. Further, the first index 21 indicates the character "M" to thereby indicate the fact that the type of the calendar information is the month. Further, the first index 21 indicates the character "L" to thereby indicate the fact that the type of the calendar information is the elapsed years.

Further, the analog electronic watch B1 is provided with the crown 3 as an external operation member, the button 4 and a button 7 each of which is also an external operation member.

Further, the analog electronic watch B1 is provided with the first function hand 61 and the second function hand 62 disposed in the third small window 60. The function hands 61, 62 indicate the alarm time and measured time of the chronograph function. Here, the function hands 61, 62 each constitute a third index according to the invention. It should be noted that one of the function hands 61, 62 can also be formed of a twenty-four-hour hand.

Figure 22:
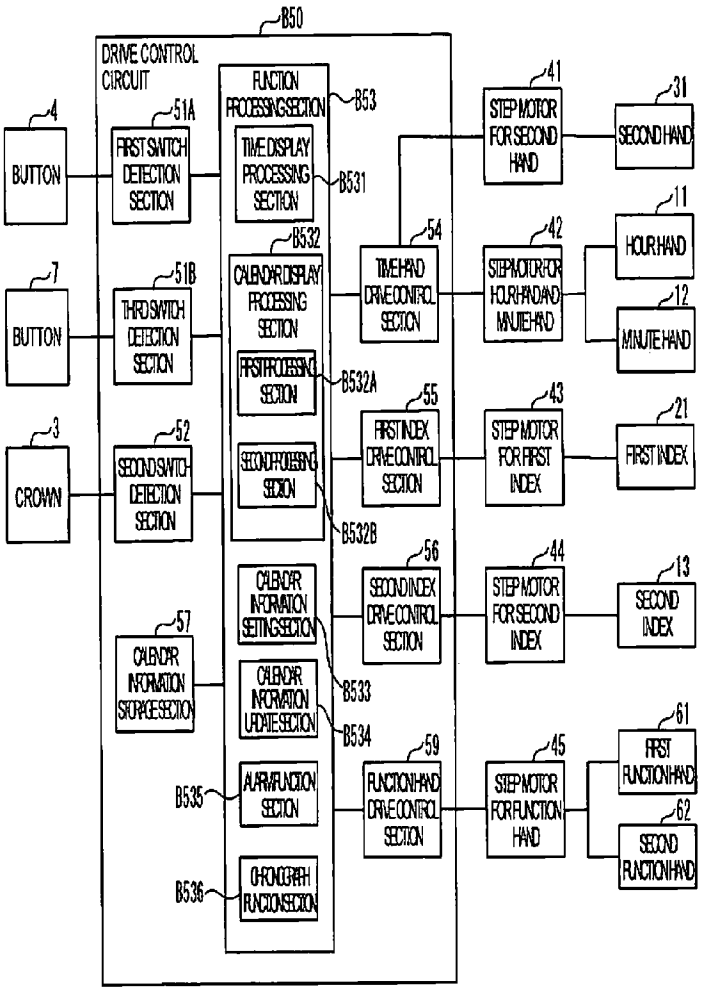
FIG. 22 is a block diagram showing a configuration of the analog electronic watch according to the sixth embodiment.

FIG. 22 is a block diagram showing a configuration of the analog electronic watch B1.

As shown in FIG. 22, the indexes 11 through 13, 21, 31, 61, and 62 are respectively driven by five step motors. Specifically, the second hand 31 is driven by the step motor 41 for the second hand, the hour hand 11 and the minute hand 12 are driven by the step motor 42 for the hour hand and the minute hand, the first index 21 is driven by the step motor 43 for the first index, the second index 13 is driven by the step motor 44 for the second index, and the function hands 61, 62 are driven the step motor 45 for the function hands. Here, the step motor 43 for the first index constitutes the first drive unit according to the invention, the step motor 44 for the second index constitutes the second drive unit according to the invention, and the step motor 45 for the function hands constitutes a third drive unit according to the invention. It should be noted that it is also possible for the second hand 31, the hour hand 11, and the minute hand 12 to be driven by a common step motor. Further, it is also possible for the first function hand 61 and the second function hand 62 to be driven by respective step motors.

In order to perform the drive control of each of the step motors 41 through 45, a drive control circuit B50 is incorporated in the analog electronic watch B1.

The drive control circuit B50 is provided with a first switch detection section 51A, the second switch detection section 52, a third switch detection section 51B, a function processing section B53, the time hand drive control section 54, the first index drive control section 55, the second index drive control section 56, the function hand drive control section 59, and the calendar information storage section 57.

The first switch detection section 51A detects a push-in operation of the button 4, and outputs the detection signal to the function processing section 53 in the case in which the push-in operation has occurred. Here, the first switch detection section 51A constitutes the detection section according to the invention.

The third switch detection section 51B detects a push-in operation of the button 7, and outputs the detection signal to the function processing section 53 in the case in which the push-in operation has occurred.

The function hand drive control section 59 outputs a motor drive pulse using the reference signal output from the reference signal generation circuit to control the step motor 45 for the function hands to thereby control the drive of the function hands 61, 62.

The function processing section B53 is provided with a time display processing section B531, a calendar display processing section B532, a calendar information setting section B533, and a calendar information update section B534, and is further provided with an alarm function section B535 and a chronograph function section B536 as function sections for performing the additional functions other than the calendar display function.

The time display processing section B531 is for displaying the hour, the minute, and the second of the current time with the hour hand 11, the minute hand 12, and the second hand 31 using the time hand drive control section 54. Further, it is also possible for the time display processing section B531 to control the function hand drive control section 59 to display the hour and the minute of the current time with the function hands 61, 62.

The calendar information setting section B533 and the calendar information update section B534 have substantially the same functions as those of the calendar information setting section 533 and the calendar information update section 534 of the analog electronic watch 1 according to the first embodiment.

The calendar display processing section B532 is provided with a first processing section B532A and a second processing section B532B.

The first processing section B532A controls the step motor 43 for the first index to thereby control the movement of the first index 21.

Specifically, when the button 4 is held down and the detection signal is input from the first switch detection section 51A, the first processing section B532A moves the first index 21 to make the first index 21 indicate the days of the week, the character "M" representing the month, the character "L" representing the elapsed years, the characters "AL" representing the alarm function, and the characters "CHR" representing the chronograph function in a switching manner.

Here, when making the first index 21 indicate the day of the week, the first processing section B532A makes the first index 21 indicate the character corresponding to the day-of-the-week information stored in the calendar information storage section 57 out of the characters "S" through "S" representing the seven days of the week to thereby indicate the day of the week.

The second processing section B532B controls the step motor 44 for the second index to thereby control the movement of the second index 13.

Specifically, when the type of the calendar information to be indicated by the first index 21 has been switched, the second processing section B532B makes the second index 13 indicate the number corresponding to the value of the type of the calendar information to be indicated by the first index 21 out of the calendar information stored in the calendar information storage section 57 to thereby indicate the value of the calendar information.

When the current time reaches the alarm time set in advance, the alarm function section B535 detects the fact that the current time has reached the alarm time, and then informs the user of the fact using a sounding device not shown provided to the analog electronic watch B1.

Further, the alarm function section B535 controls the step motor 45 for the function hands to thereby control the movement of the function hands 61, 62.

Specifically, in the case in which the first index 21 indicates the characters "AL," the alarm function section B535 makes the function hands 61, 62 indicate the hour and the minute of the alarm time set in advance.

It should be noted that the alarm time can be set by, for example, making the first index 21 indicate the characters "AL," and then rotationally operating the crown 3 to make the function hands 61, 62 indicate predetermined time in this state.

In the case in which the first index 21 indicates the characters "CHR," the chronograph function section B536 controls the step motor 45 for the function hands to control the movements of the function hands 61, 62 to thereby indicate the measured time of the chronograph function.

Further, when the button 7 is held down in the state in which the first index 21 indicates the characters "CHR," the chronograph function section B536 starts the time measurement. Then, the chronograph function section B536 stops the measurement when the button 7 is held down again, and resets the measured time when the button 4 is held down in the state in which the measurement stops.

Calendar Information Setting Process

The process of setting the calendar information in the present embodiment is substantially the same as that of the first embodiment. It should be noted that in the present embodiment, although the second index 13 is moved by the crown 3 being rotationally operated in the calendar information setting mode, it is also possible to arrange that the second index 13 is moved by, for example, the button 7 being pushed in.

Calendar Display Process

Then, the calendar display process will be described.

Figure 23:
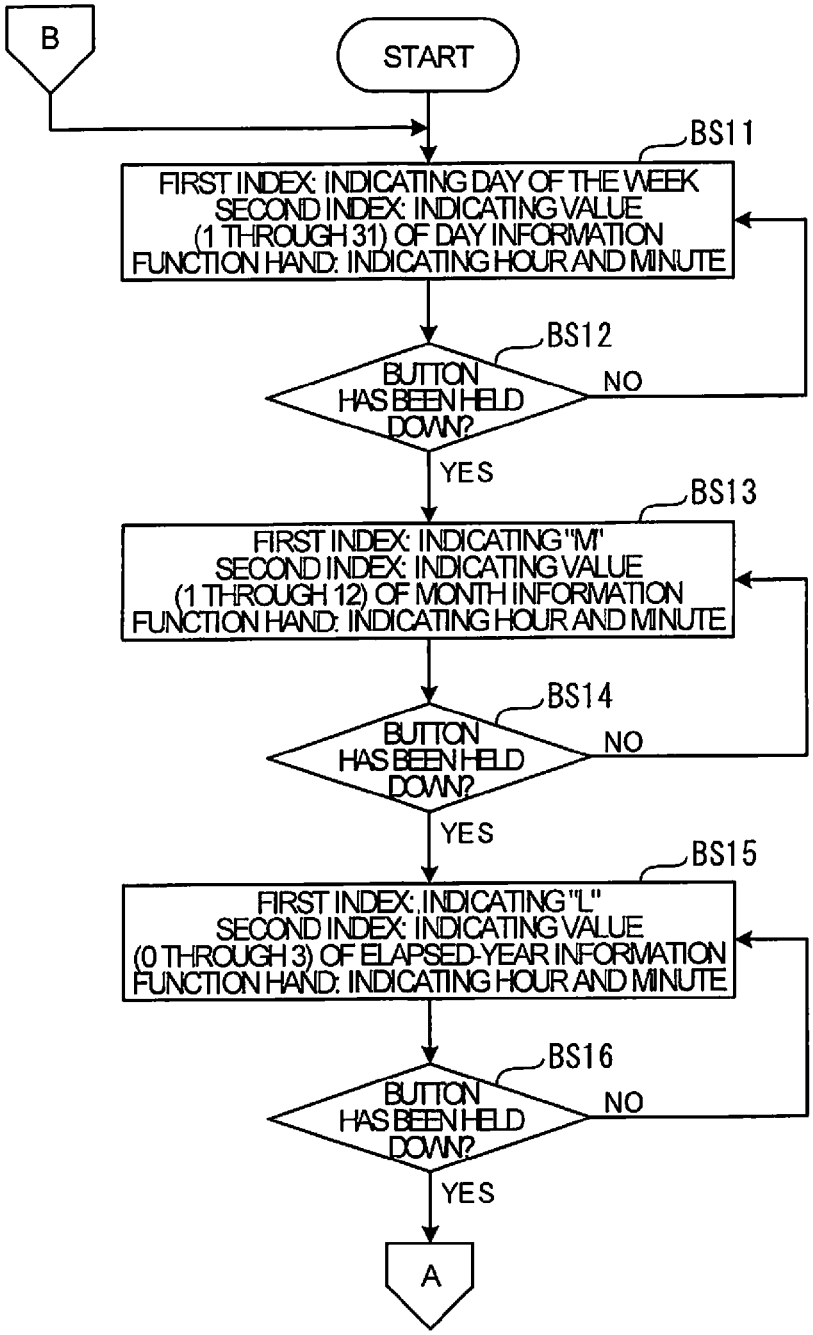
FIG. 23 is a flowchart showing a calendar display process in the sixth embodiment.
Figure 24:
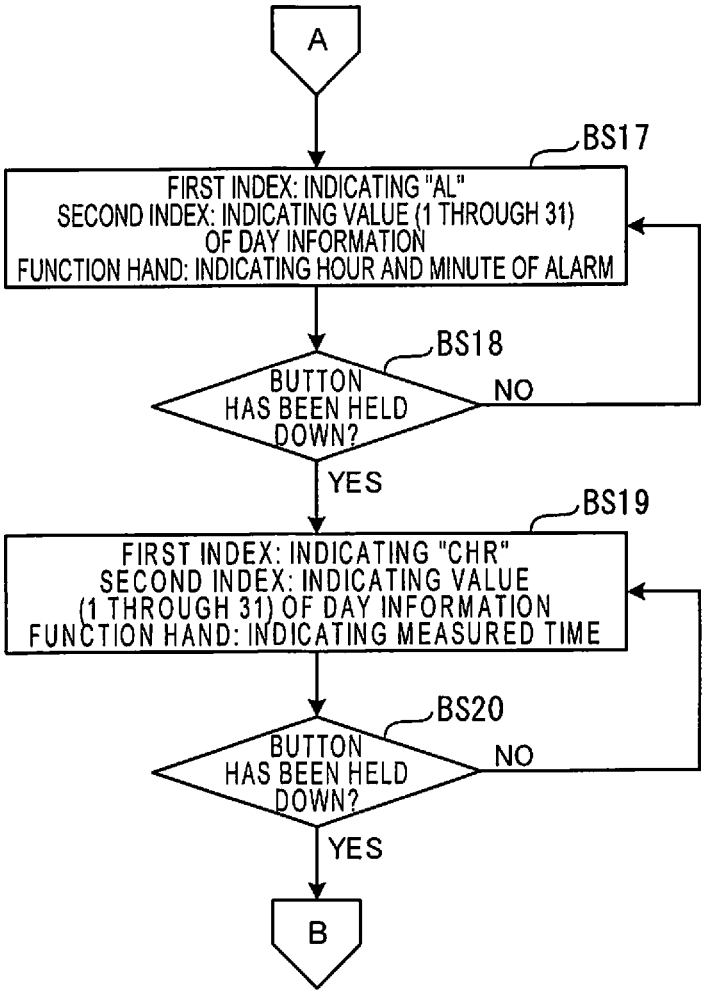
FIG. 24 is a flowchart showing the calendar display process in the sixth embodiment.

FIGS. 23 and 24 are flowcharts showing the calendar display process. The calendar display process is performed while the function processing section B53 is in the normal mode.

When the calendar display process is performed, the first processing section B532A moves the first index 21 to indicate the character corresponding to the day-of-the-week information stored in the calendar information storage section 57 out of the characters "S" through "S" representing the seven days of the week to thereby indicate the day of the week as shown in FIG. 21. Further, thus, the first processing section B532A makes the first index 21 indicate the fact that the type of the calendar information is the day. Further, the second processing section B532B moves the second index 13 to indicate the number corresponding to the value (1 through 31) of the day information stored in the calendar information storage section 57 to thereby indicate the value of the day information. Due to these operations, the day information is displayed. It should be noted that in the example shown in FIG. 21, there is displayed the $20^{th}$ day. Further, the time display processing section B531 makes the function hands 61, 62 indicate (BS11) the hour and the minute of the current time. It should be noted that this display state corresponds to a display state in the normal period.

Then, the function processing section B53 determines whether or not the detection signal is input from the first switch detection section 51A to thereby determine (BS12) whether or not the button 4 has been held down.

In the case in which the determination of NO has been made in the step BS12, the function processing section B53 continues the process of the step BS11. It should be noted that in the case in which the time has passed while the determination of YES is not made in the step BS12, and the value of the day information and the day-of-the-week information stored in the calendar information storage section 57 have been updated, the first processing section B532A moves the first index 21 to indicate the day of the week having been updated, and the second processing section B532B moves the second index 13 to indicate the value of the day information having been updated.

Figure 25:
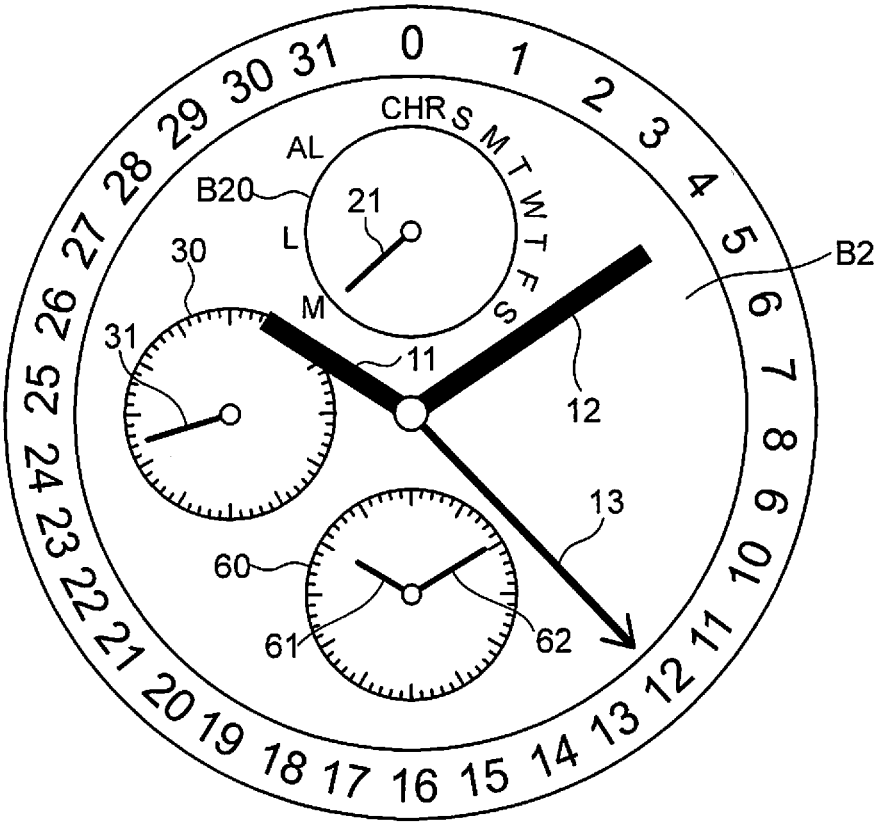
FIG. 25 is a diagram showing a display example of the analog electronic watch according to the sixth embodiment.

On the other hand, in the case in which the determination of YES has been made in the step BS12, the first processing section B532A moves the first index 21 to indicate the character "M" representing the month, and thus indicate the fact that the type of the calendar information is the month as shown in FIG. 25. Further, the second processing section B532B moves the second index 13 to indicate the number corresponding to the value (1 through 12) of the month information stored in the calendar information storage section 57 to thereby indicate the value of the month information. Due to these operations, the month information is displayed (BS13). It should be noted that in the example shown in FIG. 25, there is displayed December.

Then, the function processing section B53 determines (BS14) whether or not the detection signal has been input from the first switch detection section 51A.

In the case in which the determination of NO has been made in the step BS14, the function processing section B53 continues the process of the step BS13. It should be noted that in the case in which the time has passed while the determination of YES is not made in the step BS14, and the value of the month information stored in the calendar information storage section 57 has been updated, the second processing section B532B moves the second index 13 to indicate the value of the month information having been updated.

Figure 26:
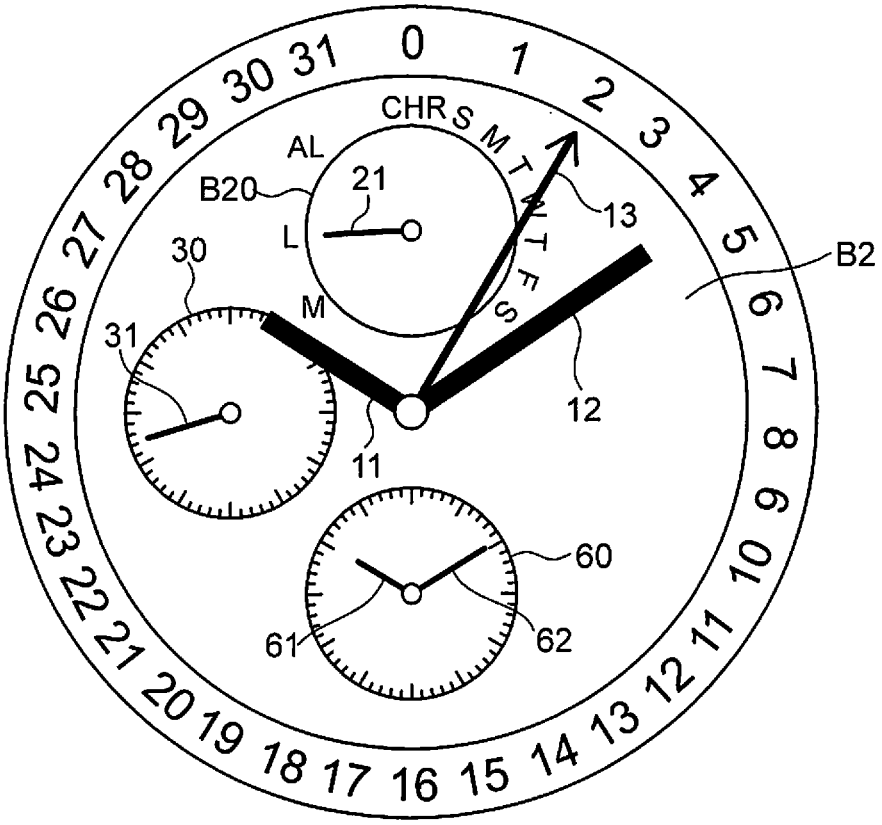
FIG. 26 is a diagram showing another display example of the analog electronic watch according to the sixth embodiment.

On the other hand, in the case in which the determination of YES has been made in the step BS14, the first processing section B532A moves the first index 21 to indicate the character "L" representing the elapsed years, and thus indicate the fact that the type of the calendar information is the elapsed years as shown in FIG. 26. Further, the second processing section B532B moves the second index 13 to indicate the number corresponding to the value (0 through 3) of the elapsed-year information stored in the calendar information storage section 57 to thereby indicate the value of the elapsed-year information. Due to these operations, the elapsed-year information is displayed (BS15). It should be noted that in the example shown in FIG. 26, there is displayed +2 years.

Then, the function processing section B53 determines (BS16) whether or not the detection signal has been output from the first switch detection section 51A.

In the case in which the determination of NO has been made in the step BS16, the function processing section B53 continues the process of the step BS15. It should be noted that in the case in which the time has passed while the determination of YES is not made in the step BS16, and the value of the elapsed-year information stored in the calendar information storage section 57 has been updated, the second processing section B532B moves the second index 13 to indicate the value of the elapsed-year information having been updated.

Figure 27:
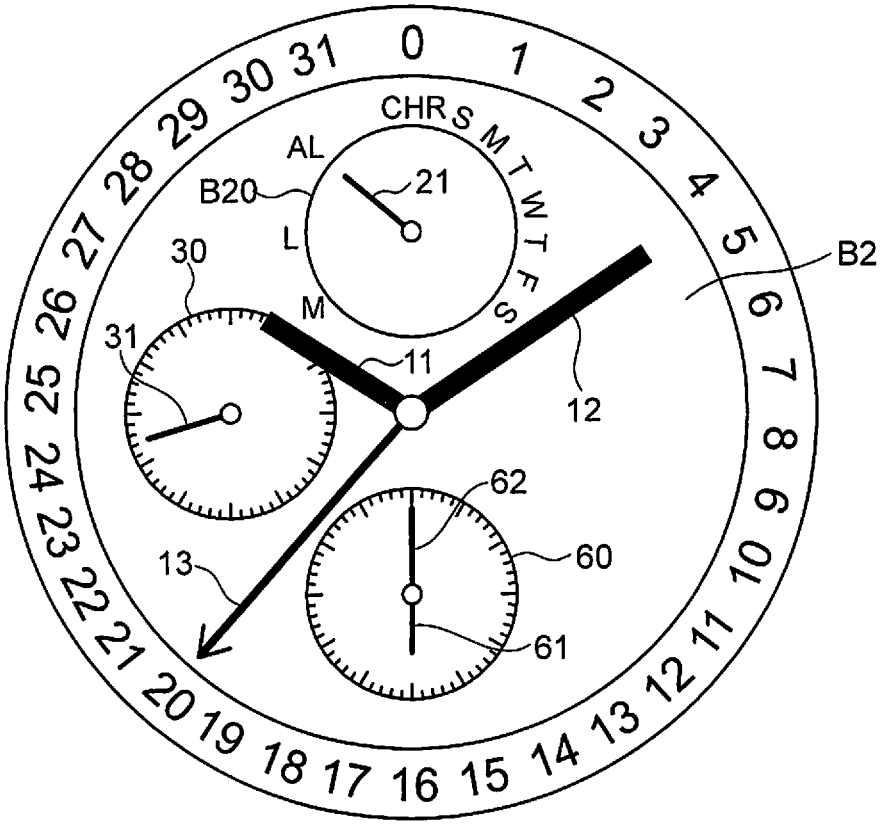
FIG. 27 is a diagram showing another display example of the analog electronic watch according to the sixth embodiment.

On the other hand, in the case in which the determination of YES has been made in the step BS16, the first processing section B532A moves the first index 21 to indicate the characters "AL," and thus indicate the alarm function as shown in FIG. 27. Further, the second processing section B532B moves the second index 13 to indicate the number corresponding to the value of the day information stored in the calendar information storage section 57. Further, the alarm function section B535 makes the function hands 61, 62 indicate (BS17) the hour and the minute of the alarm time set in advance.

Then, the function processing section B53 determines (BS18) whether or not the detection signal has been output from the first switch detection section 51A.

In the case in which the determination of NO has been made in the step BS18, the function processing section B53 continues the process of the step BS17. It should be noted that in the case in which the time has passed while the determination of YES is not made in the step BS18, and the value of the day information stored in the calendar information storage section 57 has been updated, the second processing section B532B moves the second index 13 to indicate the value of the day information having been updated.

Figure 28:
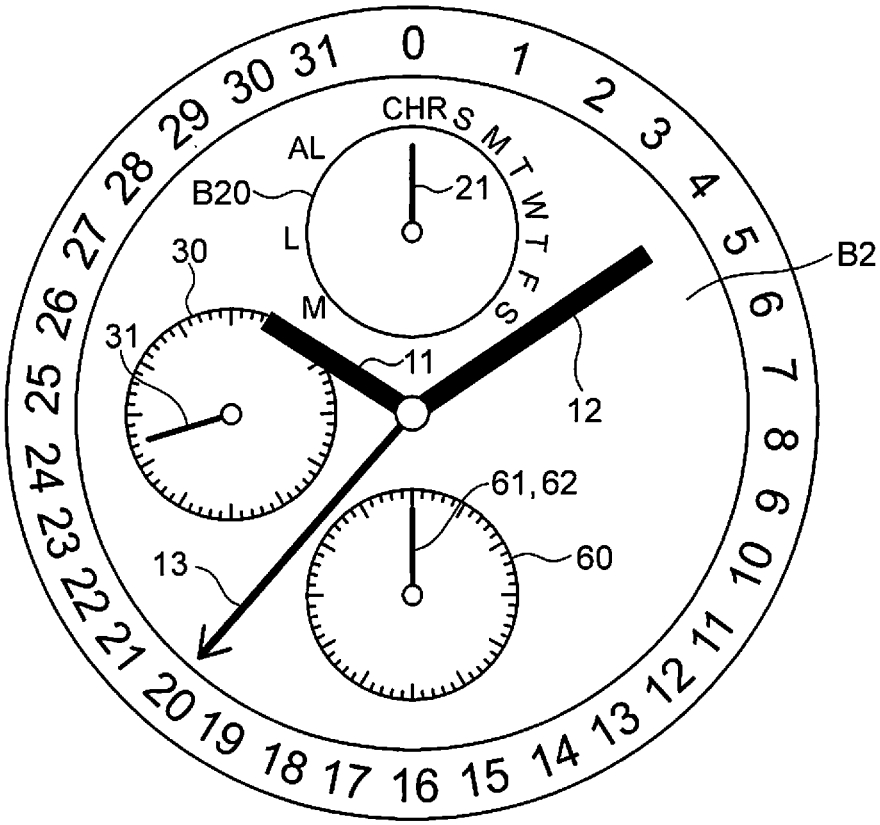
FIG. 28 is a diagram showing another display example of the analog electronic watch according to the sixth embodiment.

On the other hand, in the case in which the determination of YES has been made in the step B318, the first processing section B532A moves the first index 21 to indicate the characters "CHR," and thus indicate the chronograph function as shown in FIG. 28. Further, the chronograph function section B536 makes the function hands 61, 62 indicate the hour and the minute of the measured time (BS19). It should be noted that by driving the function hands 61, 62 with the respective step motors, it is possible to make the function hands 61, 62 indicate the minute and the second of the measured time.

Then, the function processing section B53 determines (BS20) whether or not the detection signal has been output from the first switch detection section 51A.

In the case in which the determination of NO has been made in the step BS20, the function processing section B53 continues the process of the step BS19. It should be noted that in the case in which the time has passed while the determination of YES is not made in the step BS20, and the value of the day information stored in the calendar information storage section 57 has been updated, the second processing section B532B moves the second index 13 to indicate the value of the day information having been updated.

On the other hand, in the case in which the determination of YES has been made in the step S20, the function processing section B53 returns the process to the step BS11, and then repeatedly performs the processes of the steps BS11 through BS20.

Method of Moving Second Index

Then, the method of moving the second index 13 by the second processing section B532B will be described.

The second processing section B532B moves the second index 13 in the following manner when the time has passed, the value of the calendar information stored in the calendar information storage section 57 has been updated, and the second index 13 is made to indicate the next value, or when the crown 3 has been rotationally operated in the calendar information setting mode, and the second index 13 is made to indicate the next value.

Firstly, the case in which the first index 21 is indicating the day of the week, the characters "AL," or the characters "CHR" will be described. In this case, in the case in which the second index 13 indicates either of the numbers of 1 through 30, the second index 13 is rotated clockwise (normal rotation) viewed from the obverse side of the watch to indicate the next number. Further, in the case in which the second index 13 indicates the number of 31, the second index 13 is made to rotate clockwise to indicate the number of 1 after passing through the position of indicating the number of 0 with fast-forwarding.

Then, the case in which the first index 21 is indicating the character "M" representing the month will be described. In this case, in the case in which the second index 13 indicates either of the numbers of 1 through 11, the second index 13 is rotated clockwise to indicate the next number. Further, in the case in which the second index 13 indicates the number of 12, the second index 13 is made to rotate counterclockwise (reverse rotation) to indicate the number of 1 after passing through the positions of indicating the numbers of 2 through 11.

Then, the case in which the first index 21 is indicating the character "L" representing the elapsed years will be described. In this case, in the case in which the second index 13 indicates either of the numbers of 0 through 2, the second index 13 is rotated clockwise to indicate the next number. Further, in the case in which the second index 13 indicates the number of 3, the second index 13 is made to rotate counterclockwise to indicate the number of 0 after passing through the positions of indicating the numbers of 1 and 2.

Functions and Advantages of Sixth Embodiment

The analog electronic watch B1 according to the sixth embodiment can obtain substantially the same functions and advantages with substantially the same configuration as that of the analog electronic watch 1 according to the first embodiment.

Further, when the user operates the button 4 to make the first index 21 indicate one of the types of the functions, the function hands 61, 62 indicate the information related to the type of the function indicated by the first index 21. Therefore, by checking the type of the function indicated by the first index 21, the user can check what function is related to the information indicated by the function hands 61, 62.

Further, since the second index 13 indicates the value of the day information while the first index 21 is indicating the type of the function, the user can check the information related to the function and the day information at the same time.

The user can check the alarm time based on the indication of the function hands 61, 62 by operating the button 4 to make the first index 21 indicate the alarm function. Further, by making the first index 21 indicate the chronograph function, the user can check the measured time of the chronograph function based on the indication of the function hands 61, 62.

Further, since the function hands 61, 62 indicate the hour and the minute of the current time in the case in which the first index 21 does not indicate the alarm function or the chronograph function, it is possible to check the hour and the minute of the current time using the function hands 61, 62.

Since the alarm time and the measured time of the chronograph function are indicated by the function hands 61, 62, the number of indexes provided to the analog electronic watch B1 can be reduced compared to the case of providing a dedicated index to the indication of the alarm time and a dedicated index to the indication of the measured time. Thus, the number of step motors and gears can also be reduced. Further, since the indication area can be enlarged, the alarm time and the measured time can be displayed in an easy-to-understand manner.

Seventh Embodiment

An analog electronic watch B1A according to a seventh embodiment of the invention is provided with a timer function for measuring the time based on the time set in advance in a countdown manner instead of the chronograph function with respect to the analog electronic watch B1 according to the sixth embodiment.

Figure 29:
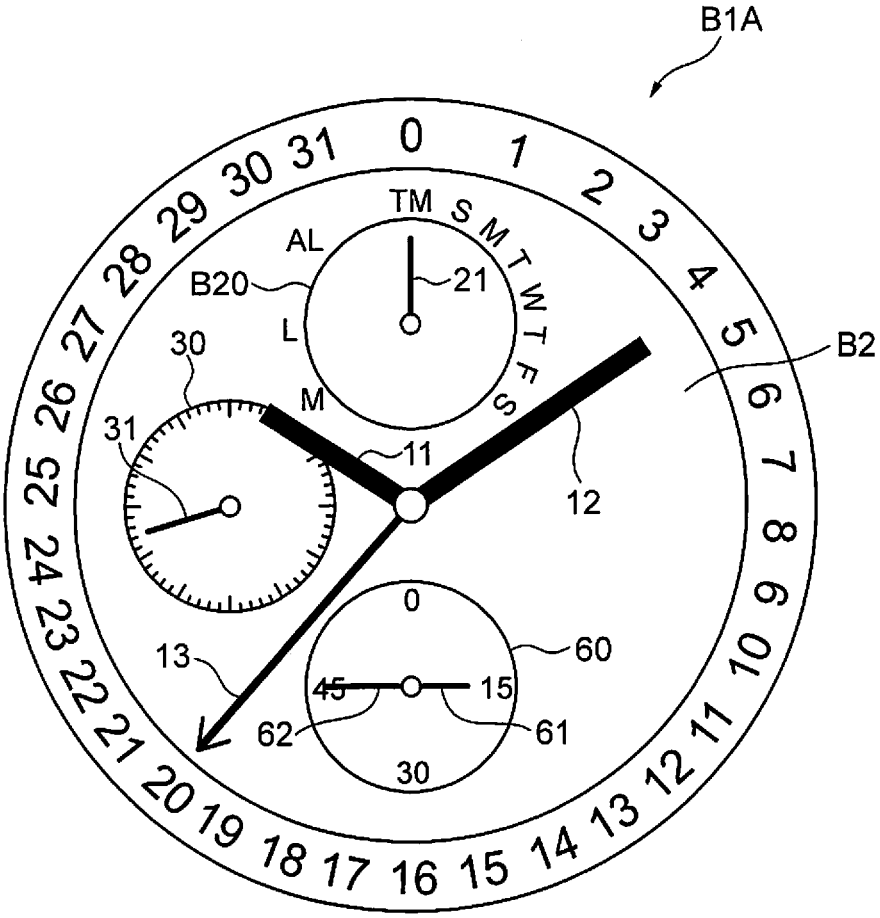
FIG. 29 is a front view of an analog electronic watch according to a seventh embodiment of the invention.

FIG. 29 is a front view showing the analog electronic watch B1A. It should be noted that the same constituents as those of the analog electronic watch B1 according to the sixth embodiment are provided with the same reference symbols, and the explanation thereof will be omitted.

As shown in FIG. 29, in the analog electronic watch B1A, characters of "TM" representing the timer function are displayed in the vicinity of the 12 o'clock position of the first small window B20 in the periphery of the first small window B20.

The first index 21 indicates the characters "TM" to thereby indicate the timer function.

Further, in the outer periphery of the third small window 60, there are displayed numbers of "0," "15," "30," and "45" representing the remaining time (minute) of the timer function.

The function hands 61, 62 indicate the measured time of the timer function.

In the seventh embodiment, the function processing section B53 is provided with a timer function section as the function section for performing an additional function other than the calendar display function. In the case in which the first index 21 indicates the characters "TM," the timer function section makes the function hands 61, 62 indicate the minute and the second of the measured time of the timer function. It should be noted that in the seventh embodiment, the function hands 61, 62 are driven by the respective step motors.

Further, when the button 7 is held down in the state in which the first index 21 indicates the characters "TM," the timer function section starts the time measurement from the time set in advance in a countdown manner. Then, the timer function section stops the measurement when the button 7 is held down again, and resets the measured time when the button 4 is held down in the state in which the measurement stops.

The time of the time function can be set by making the first index 21 indicate the characters "TM," and then rotationally operating the crown 3 to make the function hands 61, 62 indicate predetermined time in this state.

It should be noted that the analog electronic watch B1A can also be provided with the chronograph function in addition to the timer function.

Further, in the analog electronic watch B1A, the function hand can be formed of a single index for indicating the minute of the measured time of the timer function.

Functions and Advantages of Seventh Embodiment

According also to the seventh embodiment, substantially the same functions and advantages can be obtained with substantially the same configuration as that of the sixth embodiment.

Further, the user can check the measured time of the timer function based on the indication of the function hands 61, 62 by operating the button 4 to make the first index 21 indicate the timer function.

Eighth Embodiment

An analog electronic watch B1B according to an eighth embodiment of the invention is provided with a dual time display function capable to displaying two different times instead of the chronograph function with respect to the analog electronic watch B1 according to the sixth embodiment.

Figure 30:
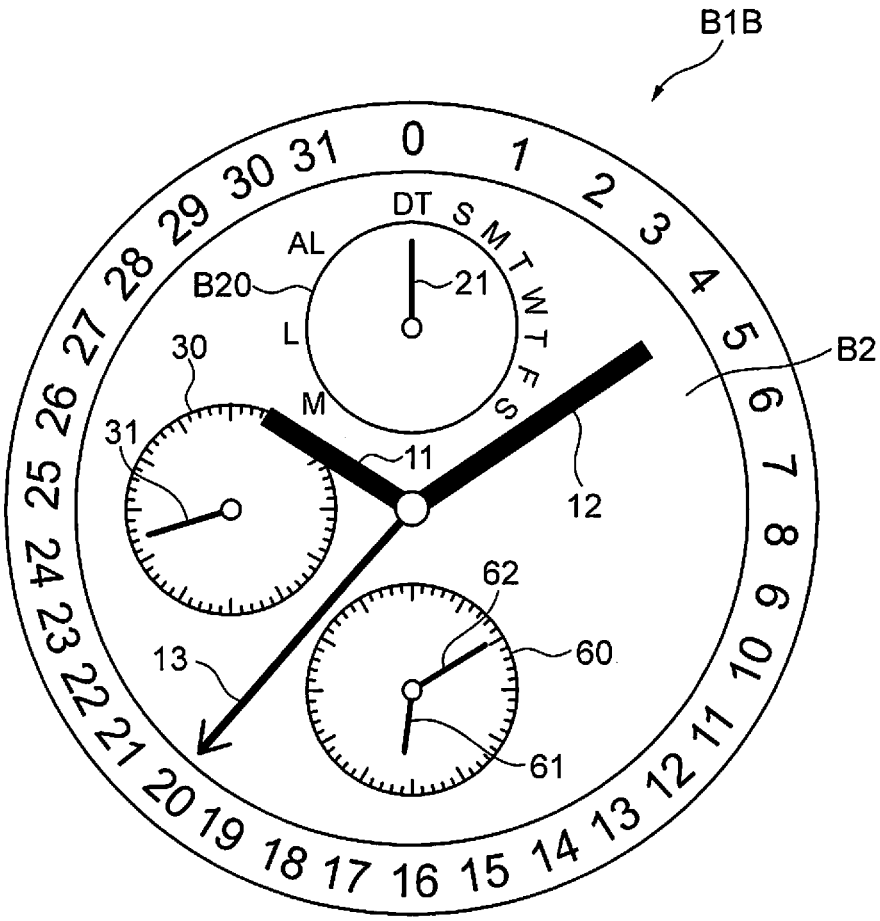
FIG. 30 is a front view of an analog electronic watch according to an eighth embodiment of the invention.

FIG. 30 is a front view of the analog electronic watch B1B. As shown in FIG. 30, in the analog electronic watch B1B, characters of "DT" representing the dual time display function are displayed in the vicinity of the 12 o'clock position of the first small window B20 in the periphery of the first small window B20.

The first index 21 indicates the characters "DT" to thereby indicate the dual time display function.

In the eighth embodiment, the function processing section B53 is provided with a dual time display function section as the function section for performing an additional function other than the calendar display function. In the case in which the first index 21 indicates the characters "DT," the dual time display function section makes the function hands 61, 62 indicate the hour and the minute of the set time.

It should be noted that the set time is set by the user operating the buttons 4, 7 and the crown 3 to make the function hands 61, 62 indicate arbitrary time.

Further, it is also possible to arrange that by displaying the names of cities from all over the world on the inner peripheral side or the outer peripheral side of the numbers of 1 through 31 on the dial plate B2, and the user operating the buttons 4, 7 and the crown 3 to make the second index 13 indicate the name of an arbitrary city, the local time of the city thus indicated is set as the set time. It should be noted that such a function is called a world time function.

It should be noted that the analog electronic watch B1B can also be provided with either one of or both of the chronograph function and the timer function in addition to the dual time display function.

Functions and Advantages of Eighth Embodiment

According also to the eighth embodiment, substantially the same functions and advantages can be obtained with substantially the same configuration as that of the sixth embodiment.

Further, the user can check the set time of the dual time display function based on the indication of the function hands 61, 62 by operating the button 4 to make the first index 21 indicate the dual time display function.

Ninth Embodiment

In an analog electronic watch B1C according to a ninth embodiment of the invention, compared to the analog electronic watch B1 according to the sixth embodiment, in the case in which the first index 21 indicates the characters "CHR," the chronograph function section B536 makes not only the function hands 61, 62 but also the second index 13 indicate the measured time. Specifically, the chronograph function section B536 makes the function hands 61, 62 indicate the hour and the minute of the measured time, and makes the second index 13 indicate the second of the measured time.

Figure 31:
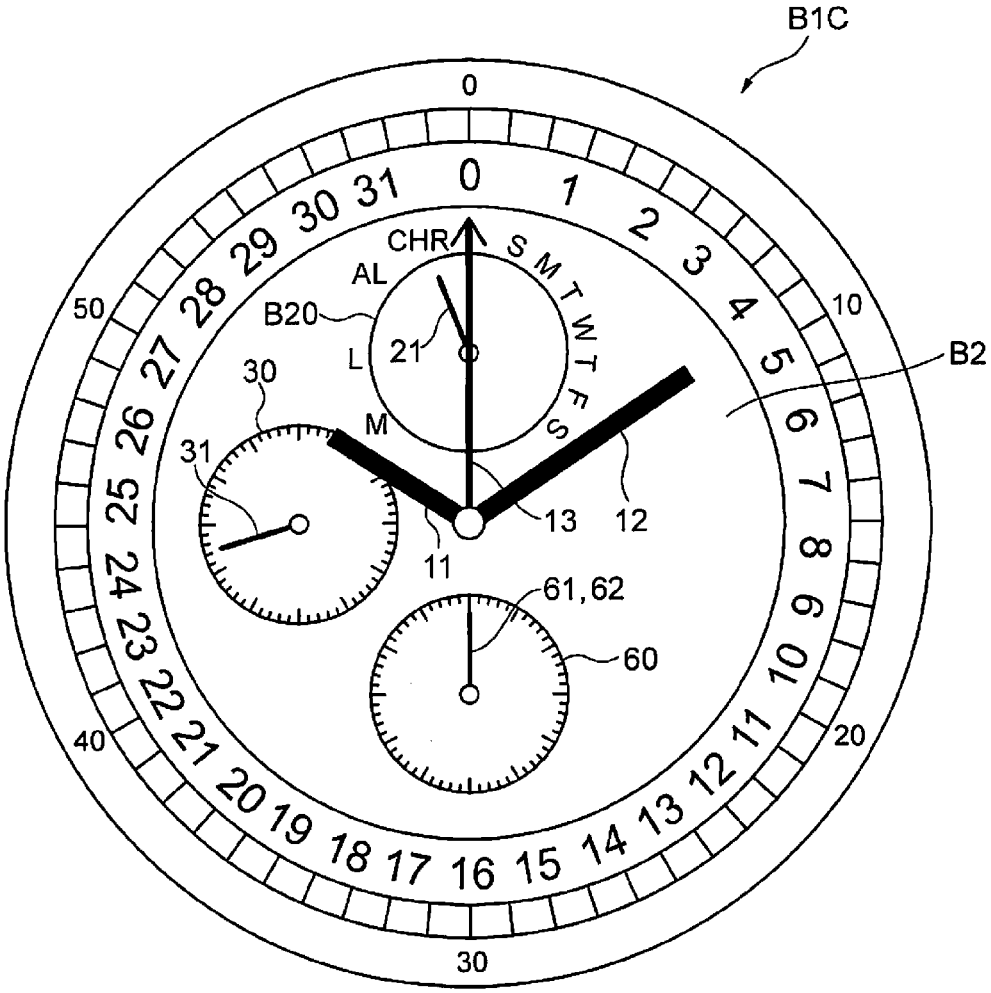
FIG. 31 is a front view of an analog electronic watch according to a ninth embodiment of the invention.

FIG. 31 is a front view of the analog electronic watch B1C. As shown in FIG. 31, in the analog electronic watch B1C, a scale and numbers representing the measured time of the chronograph function are displayed on the outer peripheral side of the numbers of 1 through 31 on the dial plate B2. It should be noted that these scale and numbers can also be displayed on the inner peripheral side of the numbers of 1 through 31.

The second index 13 indicates these scale and numbers to thereby indicate the second of the measured time of the chronograph function.

Further, the second index 13 is indicating the 12 o'clock position of the dial plate B2 before the measurement is started. On this occasion, the characters "CHR" representing the chronograph function are displayed in the vicinity of the 11 o'clock position of the first small window B20 so as not to be covered by the second index 13.

Functions and Advantages of Ninth Embodiment

According also to the ninth embodiment, substantially the same functions and advantages can be obtained with substantially the same configuration as that of the sixth embodiment.

Further, by making the function hands 61, 62 display the hour and the minute of the measured time of the chronograph function, and making the second index 13 indicate the second of the measured time, it is possible to indicate the hour, the minute, and the second of the measured time.

Other Embodiments

It should be noted that the invention is not limited to the embodiments described above, but can be implemented with a variety of modifications within the scope or the spirit of the invention.

Although in each of the embodiments described above, the first index 21 is configured so as to be able to indicate the fact that the type of the calendar information is one of the day, the month, and the elapsed years, the invention is not limited to this configuration. For example, the first index 21 can also be configured so as to be able to indicate only the day and the month. In this case, it is sufficient for the second index 13 to be configured so as to be able to indicate the numbers of 1 through 31.

Although in the first, and fourth through ninth embodiments described above, the first index 21 indicates the day of the week to thereby indicate the fact that the type of the calendar information is the day, the invention is not limited to this configuration. It is also possible to arrange that the fact that the type of the calendar information is the day is indicated by, for example, displaying the symbol representing the day in the periphery of the first small window, and making the first index 21 indicate the symbol.

Although in each of the embodiments described above, the second index 13 indicates the numbers of 0 through 31 to thereby indicate the value of the calendar information, the invention is not limited to this configuration. It is also possible to indicate the value of the calendar information by indicating, for example, the symbols corresponding to the numbers 0 through 31.

Although in each of the embodiments described above, the movement range of the second index 13 is limited in the case in which the first index 21 indicates the month and the elapsed years, the invention is not limited to this configuration. In other words, the movement range is not required to be limited.

In this case, the second index 13 moves through the positions of indicating the numbers 0 and 13 through 31 with fast-forwarding in the case in which the first index 21 indicates the month, or moves through the positions of indicating the numbers 4 through 31 with fast-forwarding in the case in which the first index 21 indicates the elapsed years. It should be noted that in the case in which the first index 21 indicates the day, the second index 13 moves the position of indicating the number 0 with fast-forwarding.

According to this configuration, since the second index 13 moves through the positions of indicating the values, which are not the setting target, with fast-forwarding in the calendar information setting process, setting of the values of the calendar information can promptly be performed compared to the case in which the second index 13 does not move with fast-forwarding.

Although in each of the embodiments, when the type of the calendar information indicated by the first index 21 is switched, the second processing section makes the second index 13 indicate the value of the type of the calendar information indicated by the first index 21 in conjunction therewith, the invention is not limited to this configuration.

In other words, the second processing section is not required to perform the movement of the second index 13 in conjunction with the first index 21.

For example, it is also possible to arrange that the switching of the indication position of the first index 21 is performed in the state in which the crown 3 is pulled out, and the second processing section moves the second index at the timing when the crown 3 is pushed in.

Although in the first and fourth through ninth embodiments, the first index 21 indicates either of the characters "S" through "S" representing the seven days of the week to thereby display the day of the week, the invention is not limited to this configuration.

It is also possible to display the day of the week by, for example, displaying a symbol representing the fact that the type of the calendar information is the day of the week in the periphery of the first small window, making the first index 21 indicate the symbol, and at the same time making the second index 13 indicate the value of the day of the week.

Although in each of the embodiments described above, the value of the calendar information is indicated by the second index 13, the invention is not limited to this configuration.

For example, it is also possible to arrange that the second hand 31 indicates the value of the calendar information. The second hand 31 is smaller in movement range than the second index 13, which is a center hand, but can sufficiently indicate the values of 0 through 31 in a recognizable range for the user.

Although in each of the embodiments described above, the calendar information stored in the calendar information storage section 57 is set by the calendar information setting process, the invention is not limited to this configuration.

It is also possible to set the calendar information by externally receiving a radio wave including the calendar information such as a time calibration signal or a satellite signal transmitted from a GPS (global positioning system) satellite.

Although in the second through fifth embodiments described above, the second index 13 indicates the value of the day information in the case in which the first index 21 indicates the charge amount, the day of the week, or the characters "AL," the invention is not limited to this configuration. Specifically, in this case, it is also possible for the second index 13 to indicate the value of the month information, the value of the elapsed-year information, or other information instead of the value of the day information. It should be noted that in this case, it is sufficient to display a symbol representing the day in the periphery of, for example, the first small window A20, and to arrange that in the case in which the first index 21 indicates the symbol, the second index 13 indicates the value of the day information.

Although in the fourth and fifth embodiments described above, in the case in which the first index 21 indicates the day of the week, the character "M" representing the month, or the character "L" representing the elapsed years, the function hands 61, 62 indicate the hour and the minute of the current time, the invention is not limited to this configuration. It is also possible for the function hands 61, 62 to indicate, for example, the alarm time.

The analog electronic watch according to each of the fourth and fifth embodiments described above is provided with the alarm function as an additional function other than the calendar display function, but can also be provided with a different function from the alarm function. Further, it is also possible to provide a plurality of additional functions.

In this case, the first index 21 is configured so as to be able to indicate the types of these functions, and in the case in which the first index 21 indicates the type of the additional function, the function hands 61, 62 indicate the information related to the function of the type thus indicated.

As the different function from the alarm function, there can be cited the chronograph function for measuring the time, the timer function for measuring the time from the time set in advance in a countdown manner, and so on. In this case, the function hands 61, 62 indicate, for example, the measured time.

Further, although in the fourth and fifth embodiments described above, the two function hands 61, 62 are provided, the invention is not limited to this configuration. For example, in the case in which only the minute of the measured time of the timer function is indicated by the function hand, the number of the function hands can be one.

Although in the sixth through ninth embodiments described above, the second index 13 indicates the value of the day information in the case in which the first index 21 indicates the day of the week or the type of the function, the invention is not limited to this configuration. Specifically, in this case, it is also possible for the second index 13 to indicate the value of the month information, the value of the elapsed-year information, or other information instead of the value of the day information. It should be noted that in this case, it is sufficient to display a symbol representing the day in the periphery of, for example, the first small window B20, and to arrange that in the case in which the first index 21 indicates the symbol, the second index 13 indicates the value of the day information.

Although in the sixth through ninth embodiments described above, in the case in which the first index 21 indicates the day of the week, the character "M" representing the month, or the character "L" representing the elapsed years, the function hands 61, 62 indicate the hour and the minute of the current time, the invention is not limited to this configuration. It is also possible to indicate the information related to the function such as the alarm time or the measured time.

Although in the sixth and ninth embodiments described above, the analog electronic watch is provided with the alarm function and the chronograph function, the invention is not limited to this configuration. Specifically, it is also possible to provide only either one of the alarm function and the chronograph function.

Further, although in the seventh and eighth embodiments described above, the analog electronic watch is provided with the alarm function, the invention is not limited to this configuration. Specifically, it is not necessary to provide the alarm function.

Further, in the analog electronic watch according to any one of the sixth through ninth embodiments described above, it is also possible to provide other functions instead of or in addition to the alarm function, the chronograph function, the timer function, and the dual time display function. In this case, the first index 21 is configured so as to be able to indicate the types of these functions, and in the case in which the first index 21 indicates the type of the function, the function hands 61, 62 indicate the information related to the function of the type thus indicated.

Further, although in the sixth through ninth embodiments described above, the two function hands 61, 62 are provided, the invention is not limited to this configuration. For example, the number of the function hands can also be one or three.

The entire disclosure of Japanese Patent Application Nos. 2015-016351, filed Jan. 30, 2015, 2015-016352, filed Jan. 30, 2015 and 2015-016353, filed Jan. 30, 2015 are expressly incorporated by reference herein.

What is claimed is:

1. A timepiece capable of displaying a plurality of types of calendar information, comprising:

a dial plate having a sub-dial with marks that are arranged along a periphery of the sub-dial and represent seven days of week, month, and a number of years elapsed from a leap year, respectively, as the types of the calendar information;

a first index arranged relative to the sub-dial, and adapted to indicate a type of the calendar information by pointing one of the marks of the sub-dial; and a second index adapted to indicate a value of the calendar information of the type indicated by the first index.

2. The timepiece according to claim 1, wherein the values of the calendar information indicated by the second index are numbers of 0 through 31.

3. The timepiece according to claim 1, wherein in a case in which the first index indicates the seven days of the week, the second index indicates the value of the day.

4. The timepiece according to claim 1, wherein the values of the calendar information indicated by the second index are numbers of 0 through 31, the second index is configured to make a movement with a normal rotation and a movement with a reverse rotation, and a movement range of the second index is limited within a range of indicating the numbers of 1 through 12 in a case in which the first index indicates the month, and limited within a range of indicating the numbers of 0 through 3 in a case in which the first index indicates the number of years elapsed from a leap year.

5. The timepiece according to claim 1, wherein the values of the calendar information indicated by the second index are numbers of 0 through 31, and the second index moves through a position of indicating the number of 0 with fast-forwarding in a case in which the first index indicates the seven days of the week, through positions of indicating the numbers of 0 and 13 through 31 with fast-forwarding in a case in which the first index indicates the month, and through positions of indicating the numbers of 4 through 31 with fast-forwarding in a case in which the first index indicates the number of years elapsed from a leap year.

6. The timepiece according to claim 1, further comprising:

a first drive unit adapted to drive the first index;

a second drive unit adapted to drive the second index;

an operation unit;

a detection section adapted to detect an operation to the operation unit to output a detection signal upon detection of the operation; and a calendar display processing section adapted to control the first drive unit to switch the type of the calendar information indicated by the first index upon input of the detection signal, and control the second drive unit to make the second index indicate the value of the calendar information of the type indicated by the first index upon input of the detection signal.

7. A timepiece capable of displaying a plurality of types of calendar information, comprising:

a secondary cell;

a charge amount detection section adapted to detect an amount of charge of the secondary cell;

a first index adapted to indicate the type of the calendar information; and a second index adapted to indicate a value of the calendar information of the type indicated by the first index, wherein the first index is configured so as to be able to indicate the charge amount.

8. The timepiece according to claim 7, wherein the types of the calendar information which can be indicated by the first index are day, month, and a number of years elapsed from a leap year, and the values of the calendar information which can be indicated by the second index are numbers of 0 through 31.

9. The timepiece according to claim 7, wherein in a case in which the first index indicates the charge amount, the second index indicates the value of the day.

10. The timepiece according to claim 7, wherein the first index is configured so as to be able to indicate a day of the week, and in a case in which the first index indicates the day of the week, the second index indicates the value of the day.

11. The timepiece according to claim 7, wherein in a case in which indication of the charge amount by the first index is absent, the first index indicates the charge amount in accordance with a drop of the charge amount to a level lower than a predetermined threshold value.

12. The timepiece according to claim 7, wherein the timepiece is capable of performing an additional function other than the function of displaying the calendar information, the first index is configured so as to be able to indicate a type of the additional function, and there is further included a third index adapted to indicate information related to the function of the type indicated by the first index in a case in which the first index indicates the type of the additional function.

13. The timepiece according to claim 12, wherein execution of the additional function is restricted in a case in which the charge amount reaches a level lower than a predetermined threshold value.

14. The timepiece according to claim 7, further comprising:

a first drive unit adapted to drive the first index;

a second drive unit adapted to drive the second index;

an operation unit;

a detection section adapted to detect an operation to the operation unit to output a detection signal upon detection of the operation; and a calendar display processing section adapted to control the first drive unit to switch an indication position of the first index upon input of the detection signal, and control the second drive unit to make the second index indicate the value of the calendar information of the type indicated by the first index in a case in which the first index indicates the type of the calendar information.

15. A timepiece capable of performing a plurality of functions including a function of displaying calendar information, comprising:

a first index adapted to indicate a type of calendar information and a type of an additional function other than the function of displaying the calendar information;

a second index adapted to indicate a value of the calendar information of the type indicated by the first index in a case in which the first index indicates the type of the calendar information; and a third index adapted to indicate information related to the function of the type indicated by the first index in a case in which the first index indicates the type of the additional function.

16. The timepiece according to claim 15, wherein the types of the calendar information which can be indicated by the first index are day, month, and a number of years elapsed from a leap year, and the values of the calendar information which can be indicated by the second index are numbers of 0 through 31.

17. The timepiece according to claim 15, wherein the first index is configured so as to be able to indicate a day of the week, and in a case in which the first index indicates the day of the week, the second index indicates the value of the day.

18. The timepiece according to claim 15, wherein one of the additional functions is an alarm function, and in a case in which the first index indicates the alarm function as the type of the additional function, the third index indicates alarm time set in the alarm function.

19. The timepiece according to claim 15, wherein one of the additional functions is a chronograph function, and in a case in which the first index indicates the chronograph function as the type of the additional function, the third index indicates measured time of the chronograph function.

20. The timepiece according to claim 15, wherein one of the additional functions is a chronograph function, and in a case in which the first index indicates the chronograph function as the type of the additional function, the second index and the third index indicate measured time of the chronograph function.

21. The timepiece according to claim 15, wherein one of the additional functions is a timer function, and in a case in which the first index indicates the timer function as the type of the additional function, the third index indicates measured time of the timer function.

22. The timepiece according to claim 15, wherein one of the additional functions is a dual time display function, and in a case in which the first index indicates the dual time display function as the type of the additional function, the third index indicates set time set in the dual time display function.

23. The timepiece according to claim 15, further comprising:

a first drive unit adapted to drive the first index;

a second drive unit adapted to drive the second index;

a third drive unit adapted to drive the third index;

an operation unit;

a detection section adapted to detect an operation to the operation unit to output a detection signal upon detection of the operation;

a calendar display processing section adapted to control the first drive unit to switch an indication position of the first index upon input of the detection signal, and control the second drive unit to make the second index indicate the value of the calendar information of the type indicated by the first index in a case in which the first index indicates the type of the calendar information; and a function section adapted to control the third drive unit to make the third index indicate information related to the function of the type indicated by the first index in a case in which the first index indicates the type of the additional function.

* * * * *